US007354325B2

(12) United States Patent
Mizuguchi et al.

(10) Patent No.: US 7,354,325 B2
(45) Date of Patent: Apr. 8, 2008

(54) OUTBOARD MOTOR CONTROL SYSTEM

(75) Inventors: Hiroshi Mizuguchi, Saitama (JP); Shinsaku Nakayama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/434,031

(22) Filed: May 15, 2006

(65) Prior Publication Data

US 2006/0264129 A1 Nov. 23, 2006

(30) Foreign Application Priority Data

May 17, 2005 (JP) ..... 2005-143647
May 20, 2005 (JP) ..... 2005-148016

(51) Int. Cl.
*B63H 20/20* (2006.01)

(52) U.S. Cl. ..... 440/75; 440/61 S; 440/86

(58) Field of Classification Search ..... None
See application file for complete search history.

(56) References Cited

U.S. PATENT DOCUMENTS 4,810,216 A * 3/1989 Kawamura ..... 440/2
4,817,466 A * 4/1989 Kawamura et al. ..... 477/112
6,868,317 B2 * 3/2005 Okuyama ..... 701/21
2004/0121661 A1 * 6/2004 Okuyama ..... 440/1
2006/0213301 A1 * 9/2006 Mizuguchi et al. ..... 74/335

FOREIGN PATENT DOCUMENTS

JP 2004-218812 8/2004
JP 2004-249791 9/2004

* cited by examiner

*Primary Examiner*—Sherman Basinger
(74) *Attorney, Agent, or Firm*—Carrier, Blackman & Associates, P.C; Joseph P. Carrier; William D. Blackman

(57) ABSTRACT

In an outboard motor control system, a position of a clutch (moved by an actuator) is memorized as a neutral position when a neutral switch produces an ON signal and the clutch position corresponding to a forward position where the clutch engages with a forward gear or a reverse position where the clutch engages with a reverse gear is determined based on the memorized position. With this, the clutch can be accurately shifted to the positions where the forward, neutral and reverse shift positions are established, thereby preventing shifting errors. Similarly, by memorizing rudder angle sensor outputs when the outboard motor is mechanically stopped by left and right steer stops as maximum leftward or rightward rudder angles, desired values for control purposes when steering the outboard motor to the maximum rudder angles can be determined as values that take the unit-specific properties of the outboard motor into account.

11 Claims, 25 Drawing Sheets

OUTBOARD MOTOR CONTROL SYSTEM

BACKGROUND OF THE INVENTION

1. Field of the Invention

This invention relates to an outboard motor control system.

2. Description of the Related Art

Japanese Laid-Open Patent Application No. 2004-218812 (particularly paragraphs 0034 to 0045; '812), for example, teaches an outboard motor configured to change shift position of the outboard motor clutch using an actuator. Specifically, the outboard motor of '812 changes shift position between forward, neutral and reverse by applying the output of the actuator to rotate a shift rod connected to the actuator so as to shift the clutch to a selected position among one where it engages a forward gear, one where it engages a reverse gear, and a neutral position where it does not engage either of these gears.

In actuator-operated shift change, a desired or specified clutch position is usually determined or defined for each shift position. However, differences may arise between the positions of the clutch where the shift positions are actually established and the desired clutch positions because of, for instance, assembly variance and allowances, aging of components, and unit-specific deviation in the output of the sensor for detecting the clutch position. So when the desired clutch positions are determined or defined as predetermined values beforehand, shifting errors may occur because the clutch is not accurately shifted to the positions where the shift positions are established.

Aside from the above, Japanese Laid-Open Patent Application No. 2004-249791, for example, teaches actuator-operated outboard motor configured to steer clockwise and counterclockwise using an actuator. This type of actuator-operated steering generally determines or defines a maximum or permissible steering angle of a steering wheel installed in the boat and controls the operation of the actuator so as to make the detected steering angle match a desired value within the maximum angle. However, differences may also arise between the desired value and the actual steering angle because of unit-specific differences among outboard motors owing to, for instance, assembly variance and allowances, aging of components, and unit-specific deviation in the output of the sensor for detecting the steering angle. So if a predetermined value is used as a desired value for control purposes when the outboard motor is steered to the maximum steering angle, there is a risk of the steering performance being degraded because the outboard motor cannot be steered to the maximum steering angle or, to the contrary, the outboard motor is steered beyond the maximum steering angle to cause interference between parts.

SUMMARY OF THE INVENTION

A first object of this invention is therefore to overcome this drawback by providing an outboard motor control system that prevents shifting errors by accurately moving the clutch to the positions where the forward, neutral and reverse shift positions are established.

A second object of this invention is to provide an outboard motor control system that regulates the outboard motor steering angle to the maximum angles with good accuracy, thereby preventing degradation of steering performance owing to insufficient steering angle and interference between parts owing to excessive steering angle.

In order to achieve the first object, this invention provides a system for controlling shift change of an outboard motor mounted on a stern of a boat and having an internal combustion engine to power a propeller, comprising a clutch being engageable with a forward gear to make the boat to propel in a forward direction or a reverse gear to make the boat to propel in a reverse direction; an actuator moving the clutch to one from among a first position to engage with the forward gear to establish a forward position, a second position to engage with the reverse gear to establish a reverse position, and a third position to engage neither with the forward gear nor with the reverse gear to establish a neutral position; a switch producing an output when the clutch is moved to the third position; a clutch position memorizer memorizing a position of the clutch as the neutral position when the switch produces the output; and a clutch position determiner determining a position of the clutch corresponding to the first position or the second position based on the memorized position of the clutch.

In order to achieve the second object, this invention provides a system for controlling steering of an outboard motor mounted on a stern of a boat and having an internal combustion engine to power a propeller, comprising an actuator steering the outboard motor relative to the boat; a left steer stop mechanically stopping leftward steering of the outboard motor; a right steer stop mechanically stopping rightward steering of the outboard motor: a rudder angle sensor producing an output indicating a rudder angle of the outboard motor; and a maximum rudder angle memorizer memorizing the output of the rudder angle sensor as a maximum leftward rudder angle of the outboard motor when the outboard motor is mechanically stopped by the left steer stop, while memorizing the output of the rudder angle sensor as a maximum rightward rudder angle of the outboard motor when the outboard motor is mechanically stopped by the right steer stop.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

An outboard motor control system according to embodiments of the present invention will now be explained with reference to the attached drawings.

Figure 1:
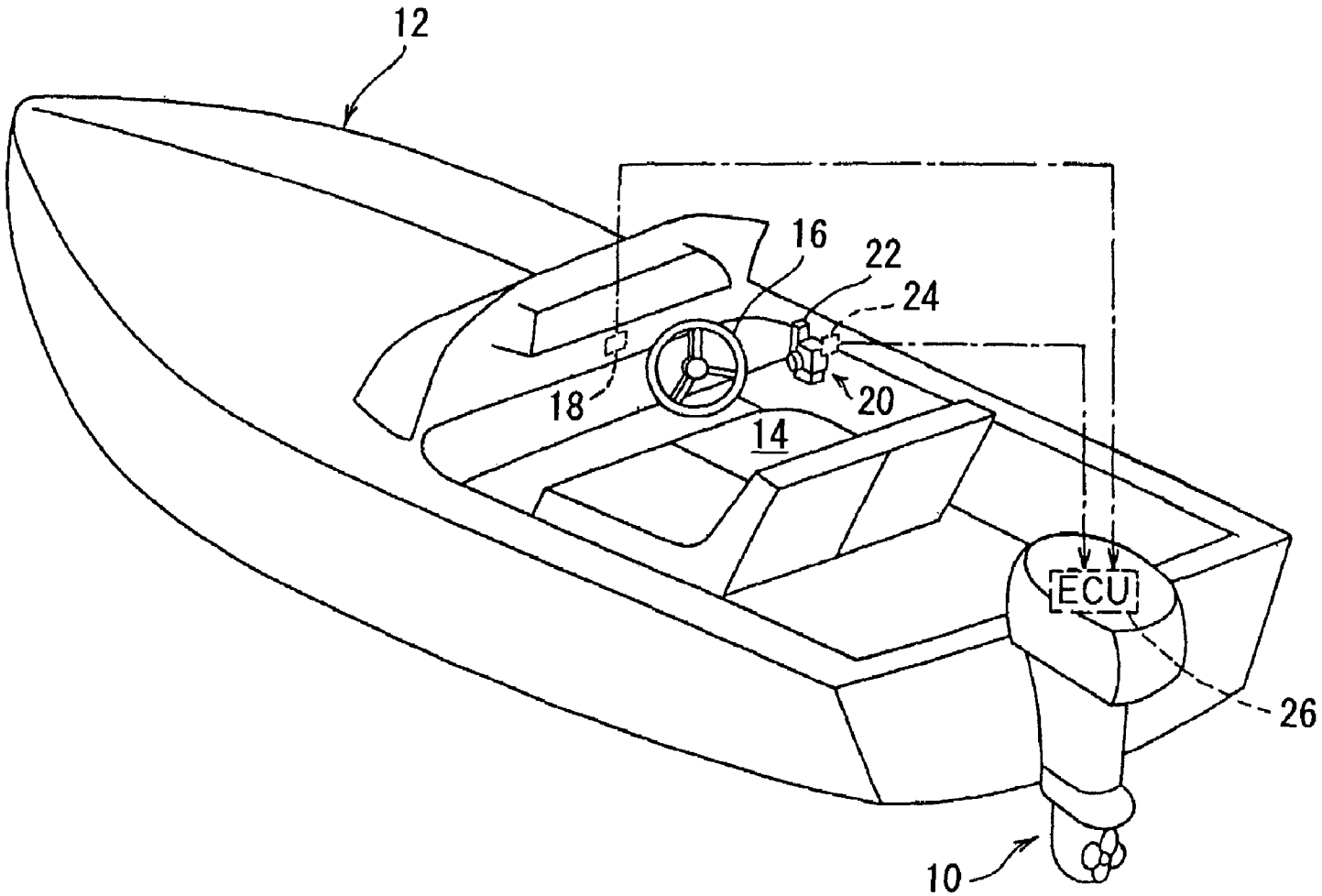
FIG. 1 is an overall schematic view of an outboard motor control system according to a first embodiment of the invention.
Figure 2:
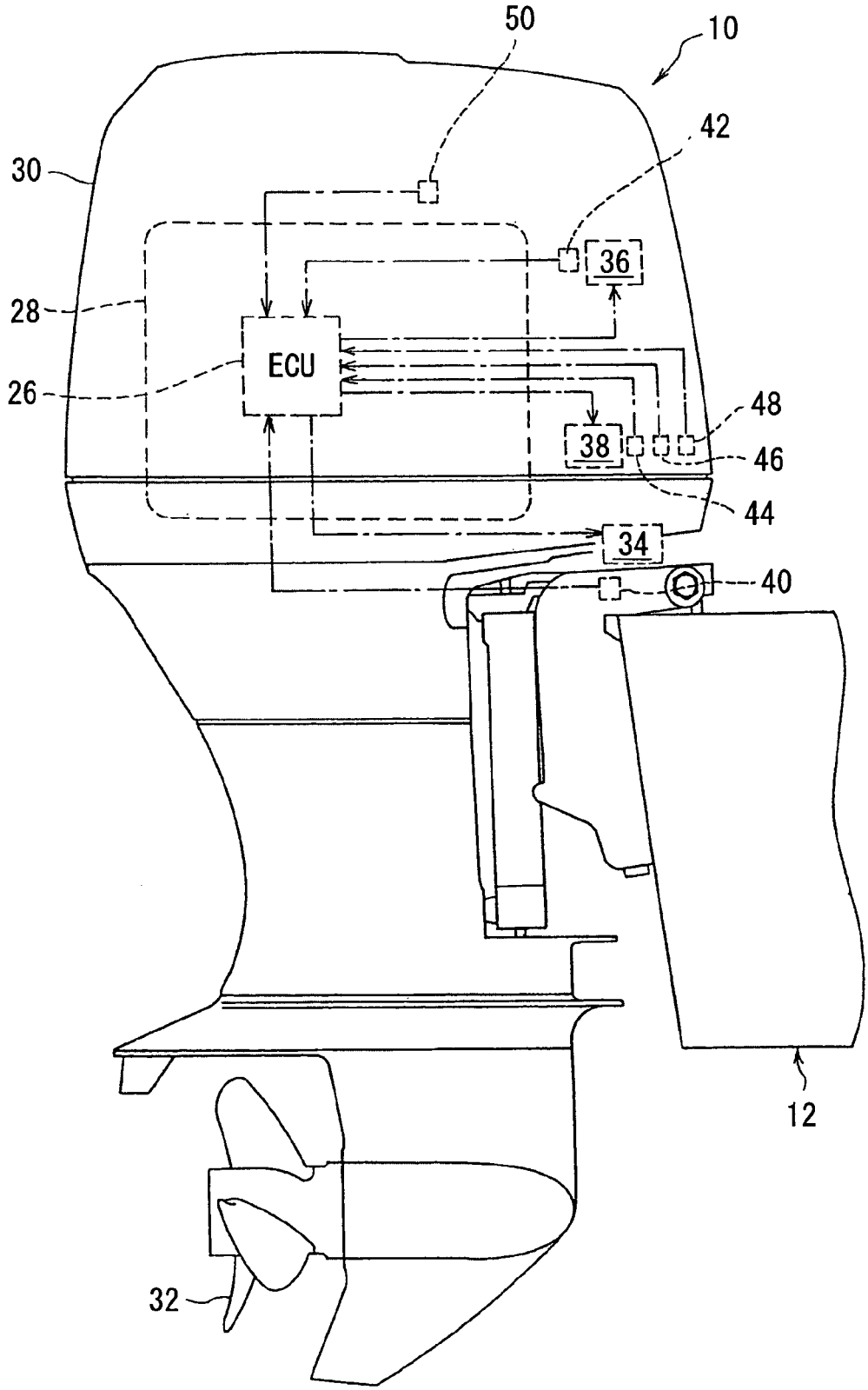
FIG. 2 is an enlarged side view of an outboard motor shown in FIG. 1.

FIG. 1 is an overall schematic view of an outboard motor control system according to a first embodiment of the invention and FIG. 2 is an enlarged side view of an outboard motor shown in FIG. 1.

In FIGS. 1 and 2, the symbol 10 indicates an outboard motor. The outboard motor 10 is mounted on the stern or transom of a boat (hull) 12. As shown in FIG. 1, a steering wheel 16 is installed near a cockpit (the operator's seat) 14 of the boat 12. A steering angle sensor 18 is installed near a rotary shaft (not shown in FIGS. 1 and 2, but shown in FIGS. 15 and 23 as "16*a*") of the steering wheel 16 and produces an output or signal indicative of the steering angle of the steering wheel 16 operated by the operator.

A remote control box 20 is installed near the cockpit 14. The remote control box 20 is provided with a lever 22. The lever 22 is free to be rotated fore and aft (toward and away from the operator) from the initial position, and is positioned to be manipulated by the operator to input an instruction to shift (change gears) or to regulate a speed of an internal combustion engine.

The remote control box 20 is equipped with a lever position sensor 24 that produces an output or signal corresponding to a position to which the lever 22 is manipulated by the operator. The outputs from the steering angle sensor 18 and lever position sensor 24 are sent to an electronic control unit (hereinafter referred to as "ECU") 26 mounted on the outboard motor 10. The ECU 26 comprises a microcomputer.

As shown in FIG. 2, the outboard motor 10 is equipped with the internal combustion engine (now assigned with symbol 28; hereinafter referred to as "engine") at its upper portion. The engine 28 comprises a spark-ignition gasoline engine. The engine 28 is located above the water surface and covered by an engine cover 30. The ECU 26 is installed in the engine cover 30 at a location near the engine 28.

The outboard motor 10 is equipped at its lower portion with a propeller 32. The output of the engine 28 is transmitted to the propeller 32 through a shift mechanism (described below) and the like, such that the propeller 32 is rotated to generate thrust that propels the boat 12 in the forward and reverse directions.

The outboard motor 10 is further equipped with an electric steering motor (steering actuator) 34 that steers the outboard motor 10 to the right and left directions, an electric throttle motor (throttle actuator) 36 that opens and closes a throttle valve (not shown in FIG. 2) of the engine 28 and an electric shift motor (shift actuator) 38 that operates the shift mechanism.

A rudder angle sensor 40 is installed near the steering motor 34 and produces an output or signal in response to the rudder angle of the outboard motor 10. A throttle position sensor 42 is disposed near the throttle motor 36 and produces an output or signal indicative of the opening of the throttle valve. Two shift position sensors 44, 46 and one neutral switch 48 are installed near the shift motor 38. The shift position sensors 44, 46 produce outputs or signals in response to the shift (gear) position (neutral, forward or reverse). The neutral switch 48 produces an ON signal when the neutral (shift) position is established and an OFF signal when the forward or reverse (shift) position is established.

A crank angle sensor 50 is installed near a crankshaft (not shown) of the engine 28 and produces an output or signal in response to the engine speed. The outputs of the aforesaid sensors and switch are sent to the ECU 26.

The ECU 26 permits to start the operation of the engine 28 only when the neutral switch 48 outputs the ON signal, i.e., when it is detected that the shift (gear) is at the neutral position, so as to prevent the boat 12 from moving at the engine start erroneously.

The ECU 26 controls the operation of the steering motor 34 based on the outputs of the steering angle sensor 18 and rudder angle sensor 40 so that the steering angle of the outboard motor 10 converges to a desired steering angle. The ECU 26 also changes or shifts the gear position, i.e., conducts the shift change by controlling the operation of the shift motor 38 based on the output of the lever position sensor 24. When the establishment of either the forward or reverse position is detected from the outputs of the shift position sensors 44, 46, the ECU 26 controls the operation of the throttle motor 36 based on the output of the lever position sensor 24 and the output of the throttle position sensor 42 so that the engine speed converges to a desired engine speed. The two shift position sensors 44, 46 are installed to deal with occurrence of failure or the like.

Thus the outboard motor 10 according to this embodiment is provided with the manipulator (the steering wheel 16, lever 22) and the control system that is not mechanically connected to the outboard motor 10.

Figure 3:
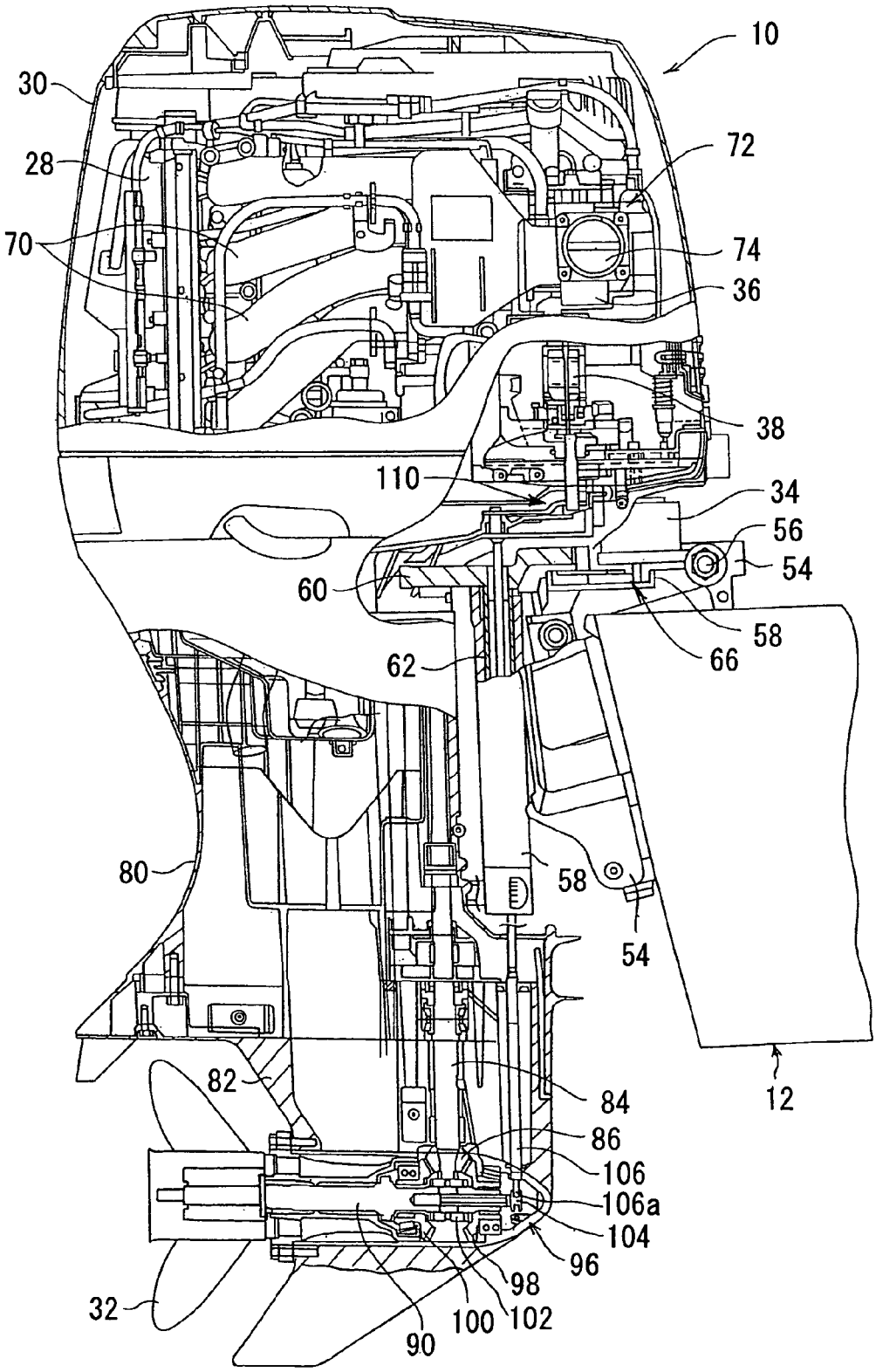
FIG. 3 is a sectional view of the outboard motor shown in FIG. 2.

The outboard motor 10 will then be described in detail with reference to FIG. 3. FIG. 3 is a partial sectional view of the outboard motor 10.

As shown in FIG. 3, the outboard motor 10 is equipped with stern brackets 54 fastened to the stern of the boat 12. A swivel case 58 is attached to the stern brackets 54 through a tilting shaft 56. The outboard motor 10 is also equipped with a mount frame 60 having a shaft member 62. The shaft member 62 is housed in the swivel case 58 to be freely rotated about a vertical axis. The upper end of the mount frame 60 and the lower end thereof, i.e., the lower end of the shaft member 62, are fastened to a frame (not shown) constituting a main body of the outboard motor 10.

The upper portion of the swivel case 58 is installed with the steering motor 34. The output shaft of the steering motor 34 is connected to the upper end of the mount frame 60 via a speed reduction gear mechanism 66. Specifically, a rotational output generated by driving the steering motor 34 is transmitted via the speed reduction gear mechanism 66 to the mount frame 60 such that the outboard motor 10 is steered about the shaft member 62 as a rotational axis to the right and left directions (i.e., steered about the vertical axis).

The engine 28 has an intake pipe 70 that is connected to a throttle body 72. The throttle body 72 has a throttle valve 74 installed therein and the throttle motor 36 is integrally disposed thereto. The output shaft of the throttle motor 36 is connected via a speed reduction gear mechanism (not shown) installed near the throttle body 72 with the throttle valve 74. Specifically, the throttle motor 36 is driven to make the throttle valve 74 move (open and close), thereby regulating the flow rate of the air sucked in the engine 28 to regulate the engine speed.

An extension case 80 is installed at the lower portion of the engine cover 30 and a gear case 82 is installed at the lower portion of the extension case 80. A drive shaft (vertical shaft) 84 is supported in the extension case 80 and gear case 82 to be freely rotated about the vertical axis. The upper end of the drive shaft 84 is connected to the crankshaft (not shown) of the engine 28 and the lower end thereof is equipped with a pinion gear 86.

A propeller shaft 90 is supported in the gear case 82 to be freely rotated about the horizontal axis. One end of the propeller shaft 90 extends from the gear case 82 toward the rear of the outboard motor 10 and the propeller 32 is attached to the one end of the propeller shaft 90.

The gear case 82 also houses the shift mechanism (now assigned with symbol 96). The shift mechanism 96 comprises a forward (bevel) gear 98, reverse (bevel) gear 100, clutch 102, shift slider 104 and shift rod 106. The forward gear 98 and reverse gear 100 are disposed onto the outer periphery of the propeller shaft 90 to be rotatable in opposite directions by engagement with the pinion gear 86. The clutch 102 is installed between the forward gear 98 and reverse gear 100 and rotates integrally with the propeller shaft 90.

The shift rod 106 is positioned parallel to the direction of the vertical axis. The clutch 102 is connected via the shift slider 104 to a rod pin 106*a* disposed on the bottom of the shift rod 106. The rod pin 106*a* is formed at a location offset from the center of the rotation of the shift rod 106 by a predetermined distance. The rotation of the shift rod 106 therefore causes the rod pin 106*a* to move while describing an arcuate locus whose radius is the predetermined distance. The movement of the rod pin 106*a* is transferred through the shift slider 104 to the clutch 102 as displacement parallel to the axial direction of the propeller shaft 90. As a result, the clutch 102 is slid to a position where it engages one or the other of the forward gear 98 and reverse gear 100 or to a position where it engages neither of them.

The interior of the engine cover 30 is provided with the shift motor 38. The output shaft of the shift motor 38 is connected to the upper end of the shift rod 106 through a speed reduction gear mechanism 110. As a result, a rotational output generated by driving the shift motor 38 is transmitted via the speed reduction gear mechanism 110 to the shift rod 106, thereby sliding the clutch 102 to conduct a shift change, specifically select a gear position from among the foregoing forward, neutral and reverse positions.

Figure 4:
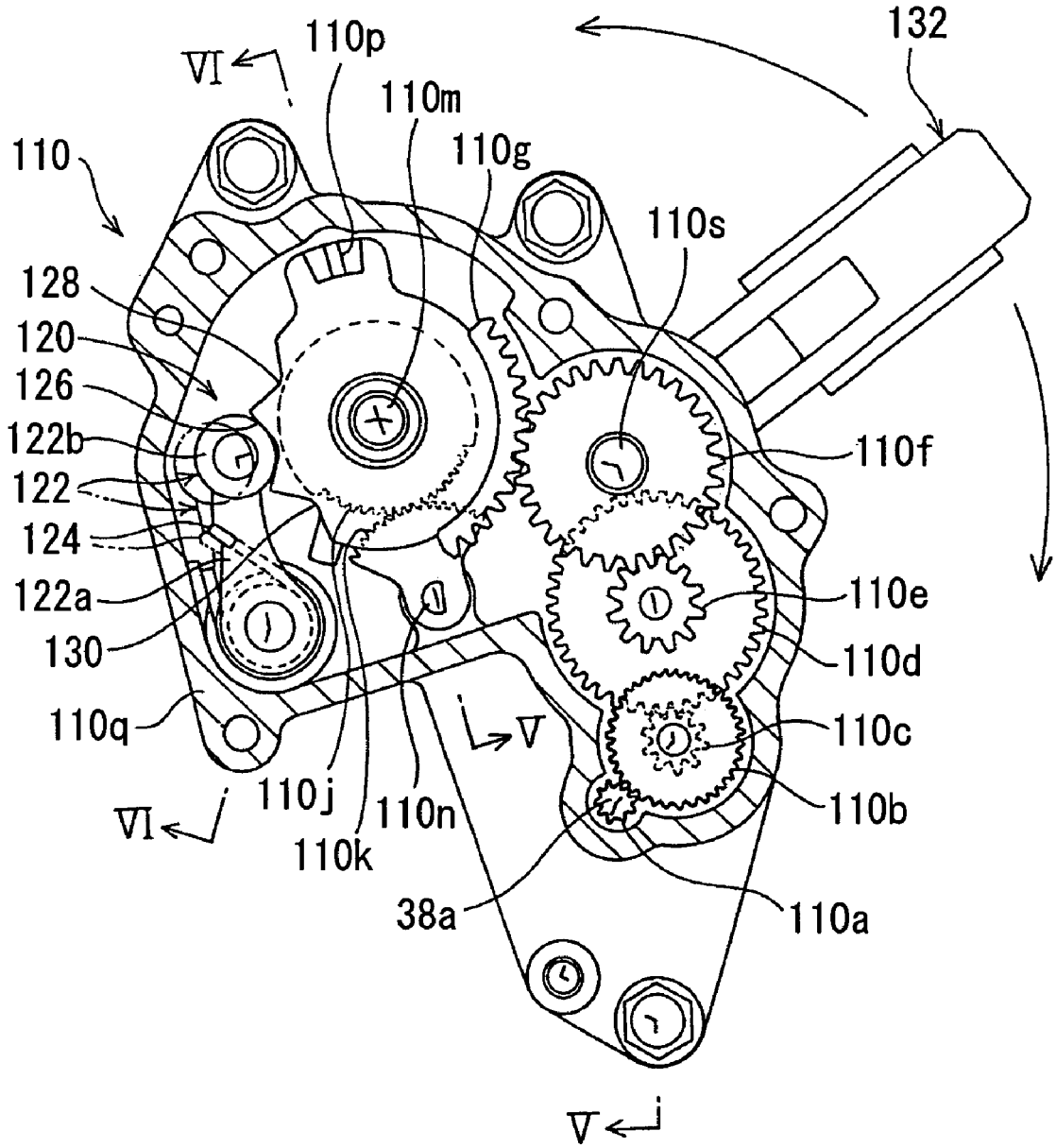
FIG. 4 is an enlarged sectional view of a speed reduction gear mechanism shown in FIG. 3.
Figure 5:
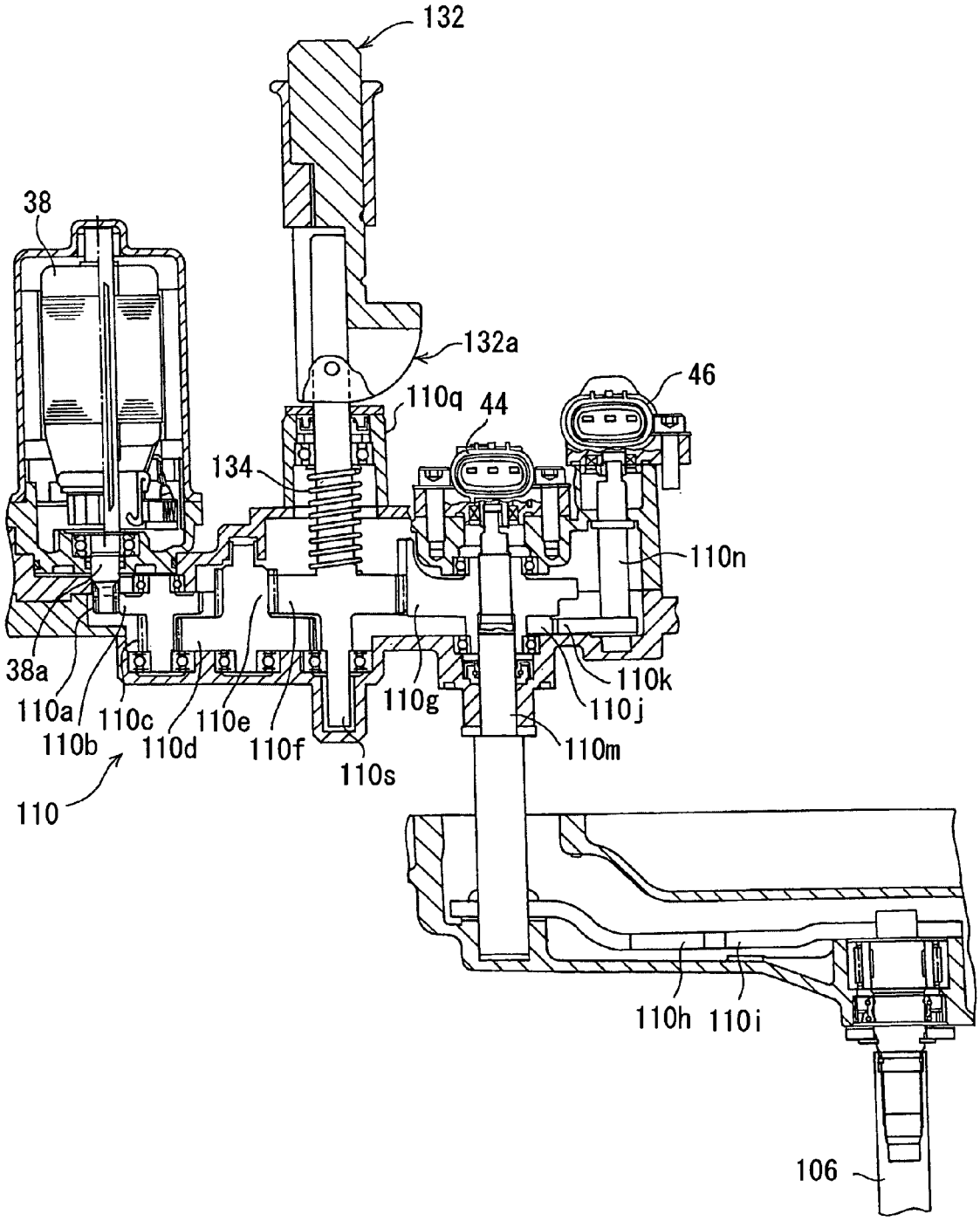
FIG. 5 is a sectional view taken along line V-V shown in FIG. 4.

FIG. 4 is an enlarged sectional view of the speed reduction gear mechanism 110 shown in FIG. 3. FIG. 5 is a sectional view taken along line V-V in FIG. 4.

As shown in FIGS. 4 and 5, the output shaft (now assigned with symbol 38*a*) of the shift motor 38 is connected to the upper end of the shift rod 106 through the speed reduction gear mechanism 110. The speed reduction gear mechanism 110 comprises a plurality of gears, specifically eleven gears, all of which are external gears.

A first gear 110*a* is provided on the shift motor output shaft 38*a* and meshes with a second gear 110*b* of larger diameter. A third gear 110*c*, which is smaller in diameter than the second gear 110*b*, is provided on the same shaft as the second gear 110*b* and meshes with a fourth gear 110*d* of larger diameter. A fifth gear 110*e*, which is smaller in diameter than the fourth gear 110*d*, is provided on the same shaft as the fourth gear 110*d* and meshes with a sixth gear 110*f* of larger diameter. The sixth gear 110*f* meshes with a seventh gear 110*g* of larger diameter.

The gears up to the seventh gear 110*g* reduce the rotational output of the shift motor 38 to a rotation angle of less than 180 degrees at the seventh gear 110*g*. Therefore, as shown in FIG. 4, teeth of the seventh gear 110*g* are formed on only part of the periphery of the seventh gear 110*g*.

An eighth gear 110*h* is provided on the same shaft as the seventh gear 110*g*. The eighth gear 110*h* meshes with a ninth gear 110*i*, which is provided on the upper end of the shift rod 106. The output of the shift motor 38 is therefore transmitted to the shift rod 106 through the first gear 110*a* to ninth gear 110*i* at reduced speed and increased torque. A tenth gear 110*j* is also provided on the same shaft as the seventh gear 110*g*. The tenth gear 110*j* meshes with an eleventh gear 110*k*.

The aforesaid shift position sensor 44 is attached to the rotary shaft 110*m* of the seventh gear 110*g*. The shift position sensor 44 produces an output indicative of the rotation angle of the rotary shaft 110*m* as the shift position signal (signal representing the position of the clutch 102). In addition, the shift position sensor 46 is attached to the rotary shaft 110*n* of the eleventh gear 110*k*. The shift position sensor 46 produces an output indicative of the rotation angle of the rotary shaft 110*n* as the shift position signal (signal representing the position of the clutch 102).

FIGS. 4 and 5 show the speed reduction gear mechanism 110 with the shift position established to neutral. In this embodiment, the output shaft 38*a* of the shift motor 38 rotates counterclockwise when the shift position is changed from neutral to forward, as viewed in FIG. 4, and rotates clockwise when it is changed from neutral to reverse.

Figure 6:
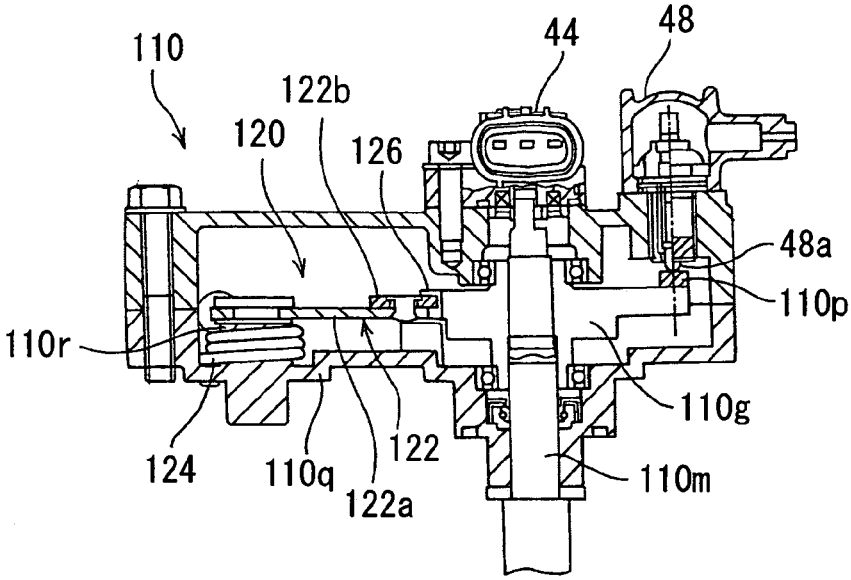
FIG. 6 is a sectional view taken along line VI-VI shown in FIG. 4.

FIG. 6 is a sectional view taken along line VI-VI in FIG. 4.

As shown in FIG. 6, the aforesaid neutral switch 48 is located above the seventh gear 110*g*. The neutral switch 48 is equipped with a detection member 48*a*. As shown in FIGS. 4 and 6, a protrusion 110*p* rising from the upper surface of the seventh gear 110*g* makes contact with the detection member 48*a* when the clutch 102 is moved to a position where it engages neither the forward gear 98 nor reverse gear 100, i.e., to the neutral position (specifically when the neutral position is established). When the protrusion 110*p* makes contact with the detection member 48*a*, in other words when the clutch 102 is displaced to the neutral position, the neutral switch 48 outputs an ON signal.

The speed reduction gear mechanism 110 is equipped with a detent mechanism 120. Once a shift position has been changed or established, the detent mechanism 120 holds the changed position. The detent mechanism 120 comprises the seventh gear 110*g*, a contact member 122 that is located near and makes contact with the seventh gear 110*g*, a coil spring (urging member) 124 for urging the contact member 122 onto the seventh gear 110*g*, and indentations 126, 128, 130 formed in the seventh gear 110*g*.

The detent mechanism 120 will be explained in detail. The contact member 122 comprises a lever 122*a* and a round portion 122*b*. A casing 110*q* of the speed reduction gear mechanism 110 is provided with a cylindrical projection 110*r* whose axial direction is parallel to the rotary shaft 110*m* of the seventh gear 110*g*. One end of the lever 122*a* is connected to the projection 110*r*. The lever 122*a* is swingable about its one end connected to the projection 110*r* and thus about an axis lying parallel to the rotary shaft 110*m*. In addition, its other end is biased toward the seventh gear 110*g* by the coil spring 124.

The other (distal) end of the lever 122*a* is attached to the round portion 122*b*. The round portion 122*b* makes contact with the portion of the periphery of the seventh gear 110*g* that is not formed with teeth. The portion of the periphery of the seventh gear 110*g* not formed with teeth (the portion contacted by the round portion 122*b*) is formed with the three indentations 126, 128, 130, i.e., with a number of indentations equal to the number of shift positions. The round portion 122*b* engages the one of the three indentations 126, 128, 130 that is associated with the current shift position.

Specifically, as shown in FIG. 4, when the clutch 102 is displaced to the neutral position, i.e., when the neutral position is established, the urging force of the coil spring 124 presses the round portion 122*b* into engagement with the indentation 126.

Figure 7:
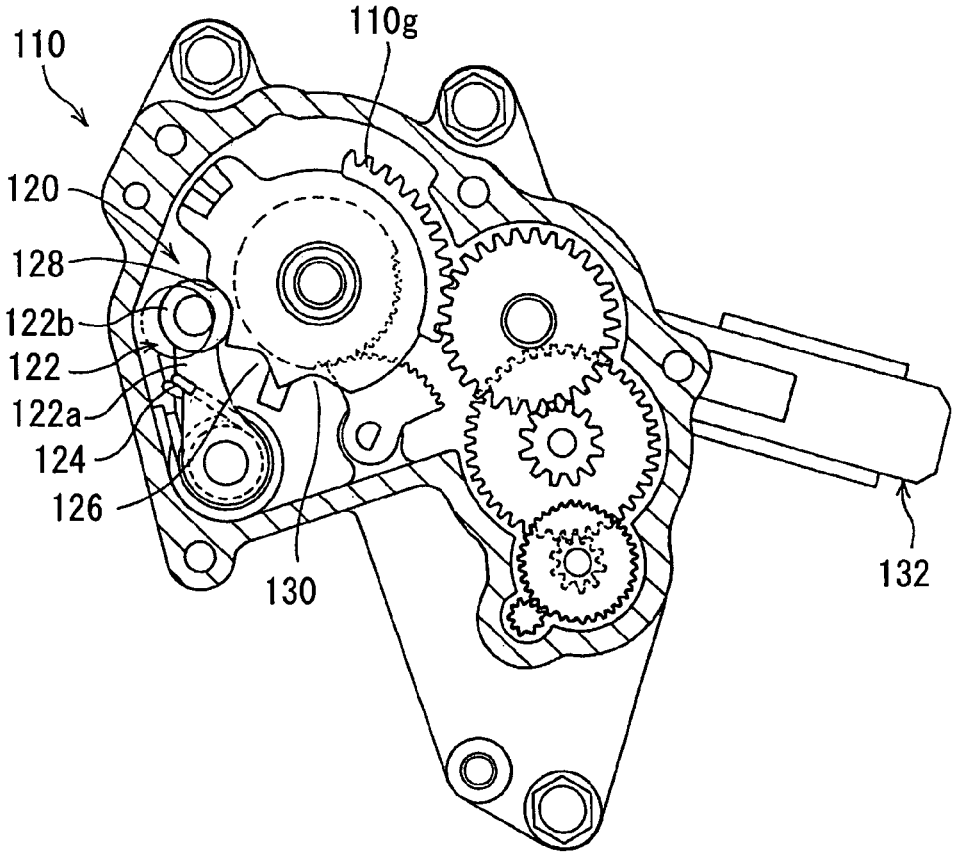
FIG. 7 is a sectional view similar to FIG. 4.

When the shift motor 38 is operated to displace the clutch 102 to a position where it engages the forward gear 98 (hereinafter called the "forward position"), i.e., when the output shaft 38*a* is turned counterclockwise as viewed in FIG. 4, the seventh gear 110*g* rotates counterclockwise, so that the round portion 122*b* engages the indentation 128 formed upward of the indentation 126 in the drawing sheet (see FIG. 7). The angle of rotation of the rotary shaft 110*m* at this time (i.e., when the clutch 102 is shifted from the neutral position to the forward position to establish the forward position) is set to be +36° (the counterclockwise rotating direction is determined or defined positive).

Figure 8:
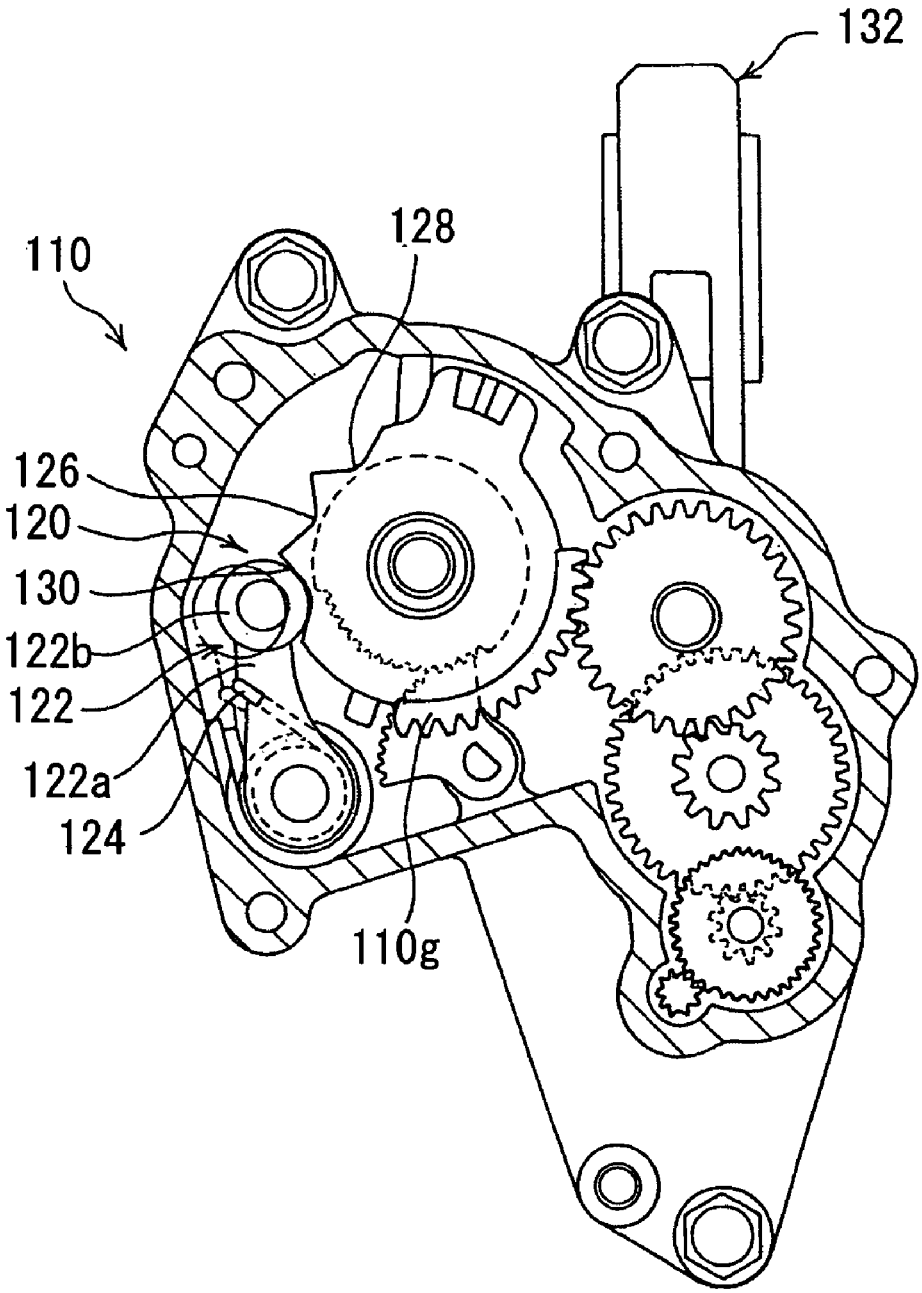
FIG. 8 is also a sectional view similar to FIG. 4.

When the shift motor 38 is operated to displace the clutch 102 to a position where it engages the reverse gear 100 (hereinafter called the "reverse position"), i.e., when the output shaft 38*a* is turned clockwise as viewed in FIG. 4, the seventh gear 10*g* rotates clockwise, so that the round portion 122*b* engages the indentation 130 formed downward of the indentation 126 in the drawing sheet (see FIG. 8). The angle of rotation of the rotary shaft 110*m* at this time (i.e., when the clutch 102 is shifted from the neutral position to the reverse position to establish the reverse position) is set to be −36°.

In other words, the forward position (first position) or reverse position (second position) is a position where the clutch 102 is moved from the neutral position (third position) by a predetermined amount (+/−36° in terms of the rotation angle of the rotary shaft 110*m*).

The explanation of FIG. 5 will be resumed. The sixth gear 110*f* is slidable in the tooth facewidth direction together with its rotary shaft 110*s*. The sixth gear 110*f* is hereinafter referred to as a "sliding gear."

As shown in FIG. 5, the gears on the upstream and downstream sides of the sliding gear 110*f* in the output transmission train of the speed reduction gear mechanism 110 (the train from the first gear 110*a* to ninth gear 110*i*), i.e., the fifth gear 110*e* and seventh gear 110*g*, are different in facewidth. Namely, the facewidth of the seventh gear 110*g* is larger than that of the fifth gear 110*e* and the difference (extra facewidth) extends upward from the level of the top surface of the fifth gear 110*e*. The sliding gear 110*f* is urged downward by a compression coil spring 134. That is, it is urged or biased in the direction of meshing with both the fifth gear 110*e* and the seventh gear 110*g*.

The upper segment of the rotary shaft 110*s* of the sliding gear 110*f* projects upward beyond the casing 110*q*, and a manual lever (manual shift mechanism) 132 is attached to the portion rising above the casing 110*q*. The lower end of the manual lever 132 is formed with a cam 132*a* that makes contact with the casing 110*q*. The manual lever 132 is positioned so that it can be freely manipulated by the operator.

Figure 9:
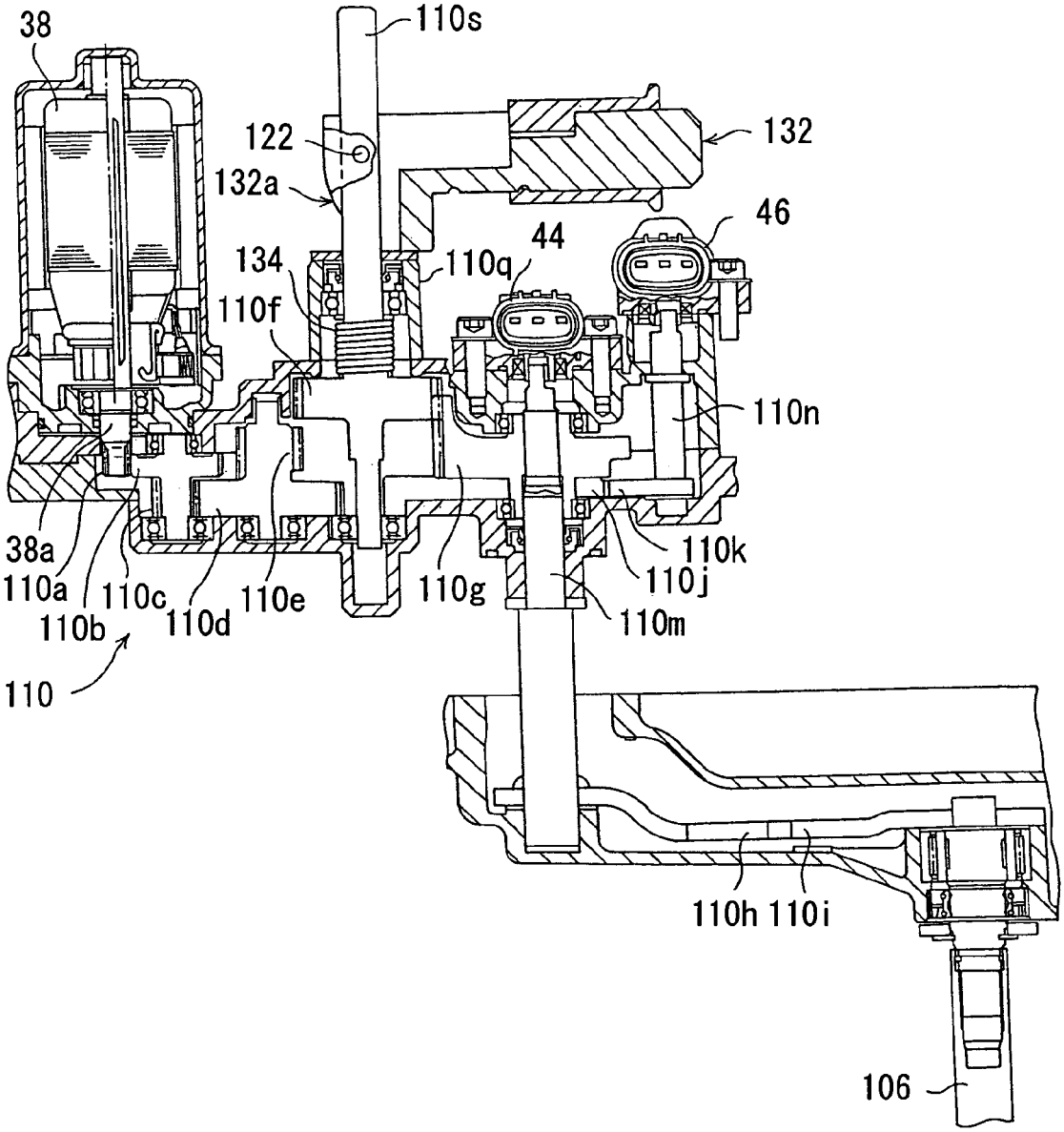
FIG. 9 is a sectional view similar to FIG. 5.

As shown in FIG. 9, the manual lever 132 can be tilted to make an angle of 90 degrees with the rotary shaft 110*s*. In FIGS. 4, 7 and 8 explained above, the manual lever 132 is shown in the tilted orientation. When the manual lever 132 is tilted, the action of the cam 132*a* slides the rotary shaft 110*s* and sliding gear 110*f* upward to release the engagement between the sliding gear 110*f* and the fifth gear 110*e*. This means that the output transmission train of the speed reduction gear mechanism 110 is broken between the sliding gear 110*f* and the fifth gear 110*e* upstream thereof.

Since the seventh gear 110*g* is given a larger facewidth than that of the fifth gear 110*e*, the sliding gear 110*f* and seventh gear 110*g* stay meshed after the sliding gear 110*f* is slid upward. Therefore, if the shift motor 38 should fail or malfunction, the shift position can still be changed manually by tilting the manual lever 132 and producing the rotations shown in FIGS. 7 and 8.

The processing operations of the control system according to the embodiment will now be explained.

Figure 10:
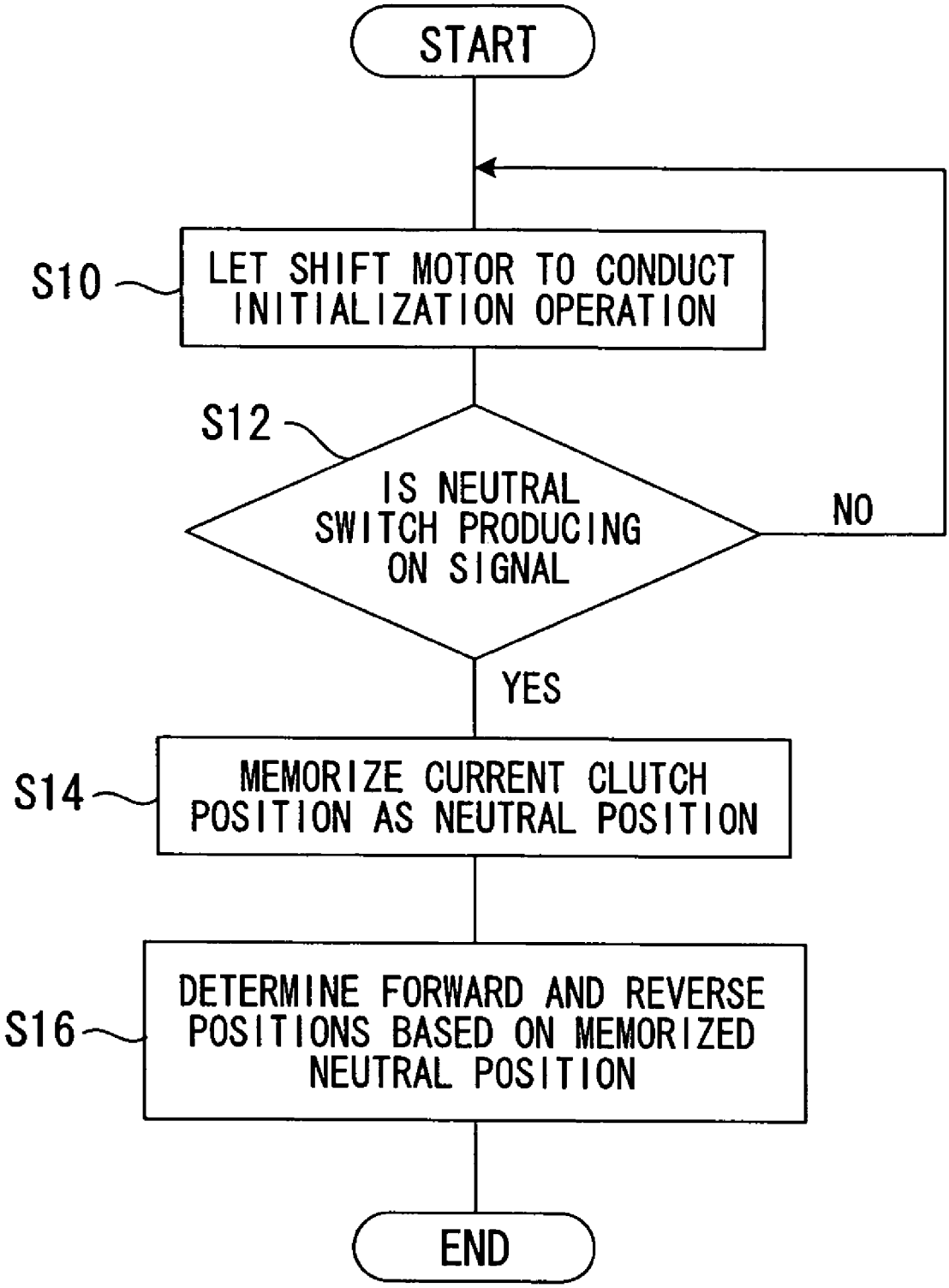
FIG. 10 is a flowchart showing the sequence of the processing operations of the control system shown in FIG. 1.

FIG. 10 is a flowchart showing the sequence of the processing operations. The illustrated routine is executed by the ECU 26 at each starting of the outboard motor 10.

First, in S10, an initialization operation of the shift motor 38 is conducted. The initialization operation is an operation for attempting to shift the clutch 102 to the neutral position.

Next, in S12, it is determined whether the neutral switch 48 is producing an ON signal. As explained earlier, the neutral switch 48 produces an ON signal when the clutch 102 has been shifted to the neutral position. The determination in S12 therefore amounts to determining whether the neutral position has been established.

When the result in S12 is NO, the program returns to S10 to repeat the initialization operation. When the result in S12 is YES, the program goes to S14, in which the current position of the clutch 102 is memorized (stored in memory) as the neutral position (desired clutch position when changing the shift position to neutral). The values actually used to indicate the neutral position are the current outputs (rotation angles) of the shift position sensors 44, 46 and these are stored in a RAM (not shown) of the ECU 26.

Next, in S16, the forward position (desired clutch position when changing the shift position to forward) and reverse position (desired clutch position when changing the shift position to reverse) are determined based on the memorized (stored) neutral position. This is done by determining or defining positions of the clutch 102 offset by predetermined amounts from the neutral position as the forward position and reverse position.

As explained above, the angle of rotation of the rotary shaft 110*m* when the clutch 102 is shifted from the neutral position to the forward position is +36°, so the value obtained by adding 36° to the output of the shift position sensor 44 stored as a value indicating the neutral position is determined or defined as the forward position.

Moreover, the angle of rotation of the rotary shaft 110*m* when the clutch 102 is shifted from the neutral position to the reverse position is −36°, so the value obtained by subtracting 36° from the output of the shift position sensor 44 stored as a value indicating the neutral position is determined or defined as the reverse position.

Similarly, the values obtained by adding and subtracting a predetermined value to and from the output of the shift position sensor 46 (angle of rotation of the rotary shaft 110*n*) stored as a value indicating the neutral position are determined or defined as the forward position and reverse position.

When the shift position is to be changed and the desired shift position is neutral, the ECU 26 controls the operation of the shift motor 38 to make the outputs of the shift position sensors 44, 46 match the angle of rotation stored as indicating the neutral position. When the desired shift position is forward, the ECU 26 controls the operation of the shift motor 38 to make the outputs of the shift position sensors 44, 46 match the angle of rotation stored as indicating the forward position. And when the desired shift position is reverse, the ECU 26 controls the operation of the shift motor 38 to make the outputs of the shift position sensors 44, 46 match the angle of rotation stored as indicating the reverse position.

As explained in the foregoing, the first embodiment of this invention provides an outboard motor control system that uses an actuator (the shift motor 38) to shift the clutch 102 to a position where it engages with either the forward gear 98 or the reverse gear 100, or the neutral position, thereby changing the shift position of the outboard motor 10 between forward, neutral and reverse, which outboard motor control system comprises: a neutral switch 48 connected to the clutch 102 for producing an output (ON signal) indicating that the neutral position has been established when the clutch 102 is not engaged with either the forward gear 98 or the reverse gear 100; neutral position memorizer (the ECU 26, S14 in the flowchart of FIG. 10) for memorizing as the neutral position the position of the clutch 102 when the neutral switch 48 produces the aforesaid output; and clutch position determiner (the ECU 26, S16 in the flowchart of FIG. 10) for using the memorized neutral position as the basis for determining or defining the position (the forward position) of the clutch 102 when the clutch 102 engages with the forward gear 98 to establish the forward position and the position (the reverse position) of the clutch 102 when the clutch 102 engages with the reverse gear 100 to establish the reverse position.

Owing to this configuration, the clutch 102 can be accurately shifted to the positions where the forward, neutral and reverse shift positions are established, thereby preventing shifting errors. A simple configuration also can be achieved because the clutch position determiner determines positions of the clutch 102 offset by predetermined amounts from the neutral position as the positions of the clutch 102 when the forward position and the reverse position are established.

Although it is explained in the foregoing that the neutral position and the forward and reverse positions are determined or defined every time the outboard motor 10 is started, it is instead possible, for example, to determine or define them only once upon completion of the assembly of the outboard motor 10 or determine them only when the outboard motor 10 is started after elapse of a predetermined period from the last time it was operated.

An outboard motor control system according to a second embodiment of the invention will now be explained.

Figure 11:
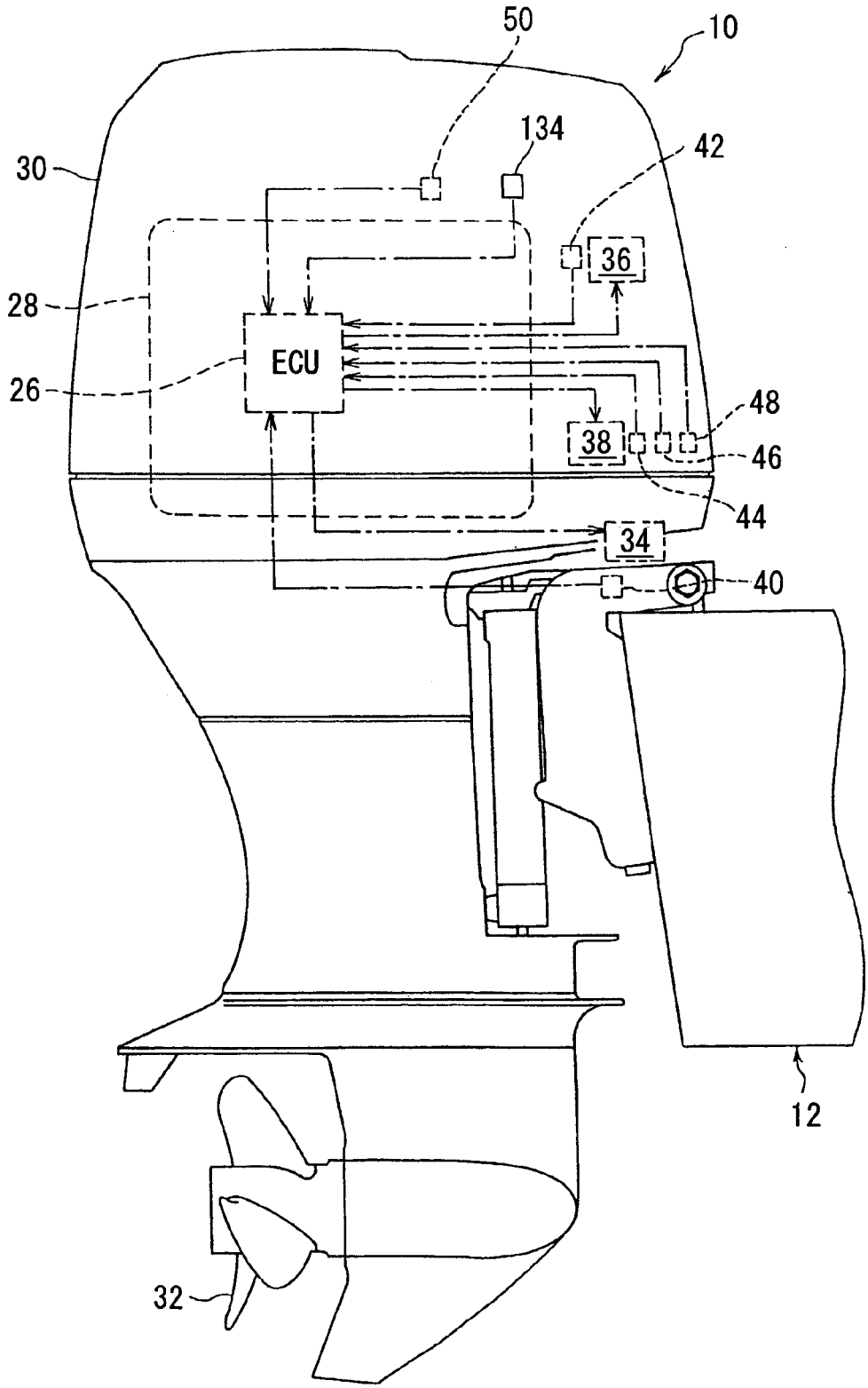
FIG. 11 is a side view of an outboard motor similar to FIG. 2 showing an outboard motor control system according to a second embodiment of the invention.

FIG. 11 is a side view of the outboard motor similar to that of FIG. 2 showing the outboard motor control system according to the second embodiment of the invention.

The second embodiment will be explained with focus on the points of difference from the first embodiment.

As shown in FIG. 11, in the second embodiment the outboard motor 10 is provided with an operator switch 134. The operator switch 134 is located to be operable by the operator. When the operator switch 134 is operated, it produces an output (ON signal) indicating that the neutral position has been established by movement of the clutch 102 to a position, i.e., the neutral position where it is not in engagement with either the forward gear 98 or the reverse gear 100. The output of the operator switch 134 is sent to the ECU 26.

The processing operations of the control system according to the second embodiment will now be explained.

Figure 12:
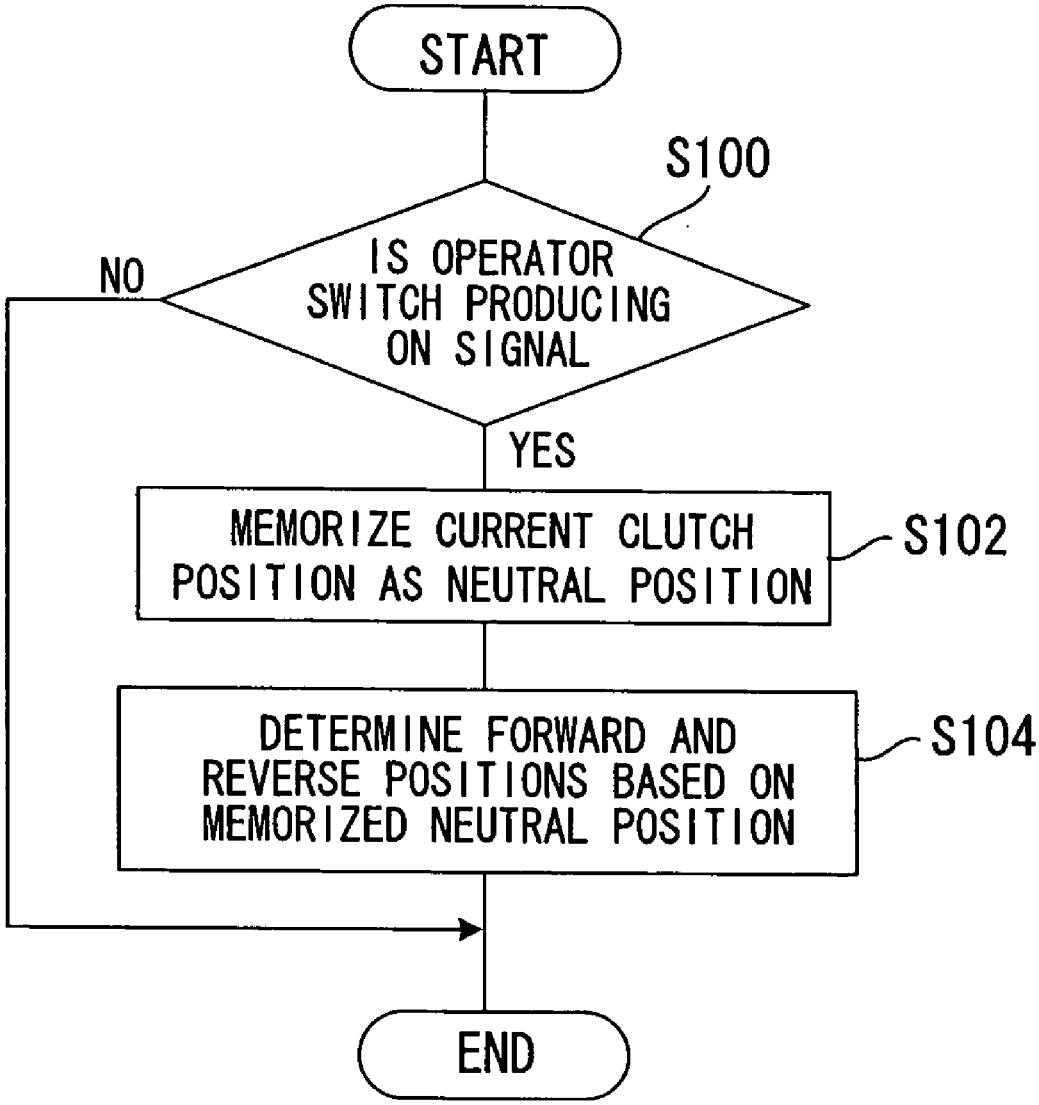
FIG. 12 is a flowchart showing the sequence of the processing operations of the control system according to the second embodiment in FIG. 11.

FIG. 12 is a flowchart showing the sequence of the processing operations. The illustrated routine is executed by the ECU 26 at predetermined intervals (e.g., every 10 milliseconds).

First, in S100, it is determined whether the operator switch 134 is producing an ON signal. When the result in S100 is YES, the program goes to S102, in which, similarly to in S14 of the flowchart of FIG. 10, the current position of the clutch 102 is memorized (stored in memory) as the neutral position. Specifically, the current outputs of the shift position sensors 44, 46 are stored in the RAM of the ECU 26 as values indicating the neutral position.

Therefore, once the neutral position has been established by operating the manual lever 132, the operator can store the exact neutral position in the ECU 26 by operating the operator switch 134 simultaneously. During manual operation of the shift mechanism 96, the detent mechanism 120 provided therein produces a click feel which enables the operator to accurately ascertain that the neutral position has been established.

Next, in S104, similarly to in S16 of the flowchart of FIG. 10, the forward position and reverse position are determined based on the memorized (stored) neutral position. This is done by determining or defining positions of the clutch 102 offset by predetermined amounts from the neutral position as the forward position and reverse position. When the result in S100 is NO, the processing of S102 and S104 is skipped. The remaining aspects of the second embodiment are the same as those of the first embodiment and will not be explained again here.

As explained in the foregoing, the second embodiment of this invention provides an outboard motor control system having the shift motor (actuator) 38 to shift the clutch 102 to a position where it engages with either the forward gear 98 or the reverse gear 100, or a neutral position, thereby changing the shift position of the outboard motor 10 between forward, neutral and reverse, which outboard motor control system comprises: a manual shift mechanism (the manual lever 132) operable by the operator for shifting the clutch 102; the operator switch 134 located to be operable by the operator that when operated produces an output (ON signal) indicating that the neutral position has been established by movement of the clutch 102 to a position where it is not in engagement with either the forward gear 98 or the reverse gear 100; neutral position memorizer (the ECU 26, S102 in the flowchart of FIG. 12) for memorizing or storing as the neutral position the position of the clutch 102 when the operator switch 134 produces the aforesaid output; and clutch position determiner (the ECU 26, S104 in the flowchart of FIG. 12) for using the memorized neutral position as the basis for determining or defining the position (the forward position) of the clutch 102 when the clutch 102 engages with the forward gear 98 to establish the forward position and the position (the reverse position) of the clutch 102 when the clutch 102 engages with the reverse gear 100 to establish the reverse position.

Owing to this configuration, similarly to in the first embodiment, the clutch 102 can be accurately shifted to the positions where the forward, neutral and reverse shift positions are established, thereby preventing shifting errors. Moreover, a simple configuration can be achieved because the clutch position determiner determines positions of the clutch 102 offset by predetermined amounts from the neutral position as the positions of the clutch 102 when the forward position and the reverse position are established.

An outboard motor control system according to a third embodiment of the invention will now be explained.

Figure 13:
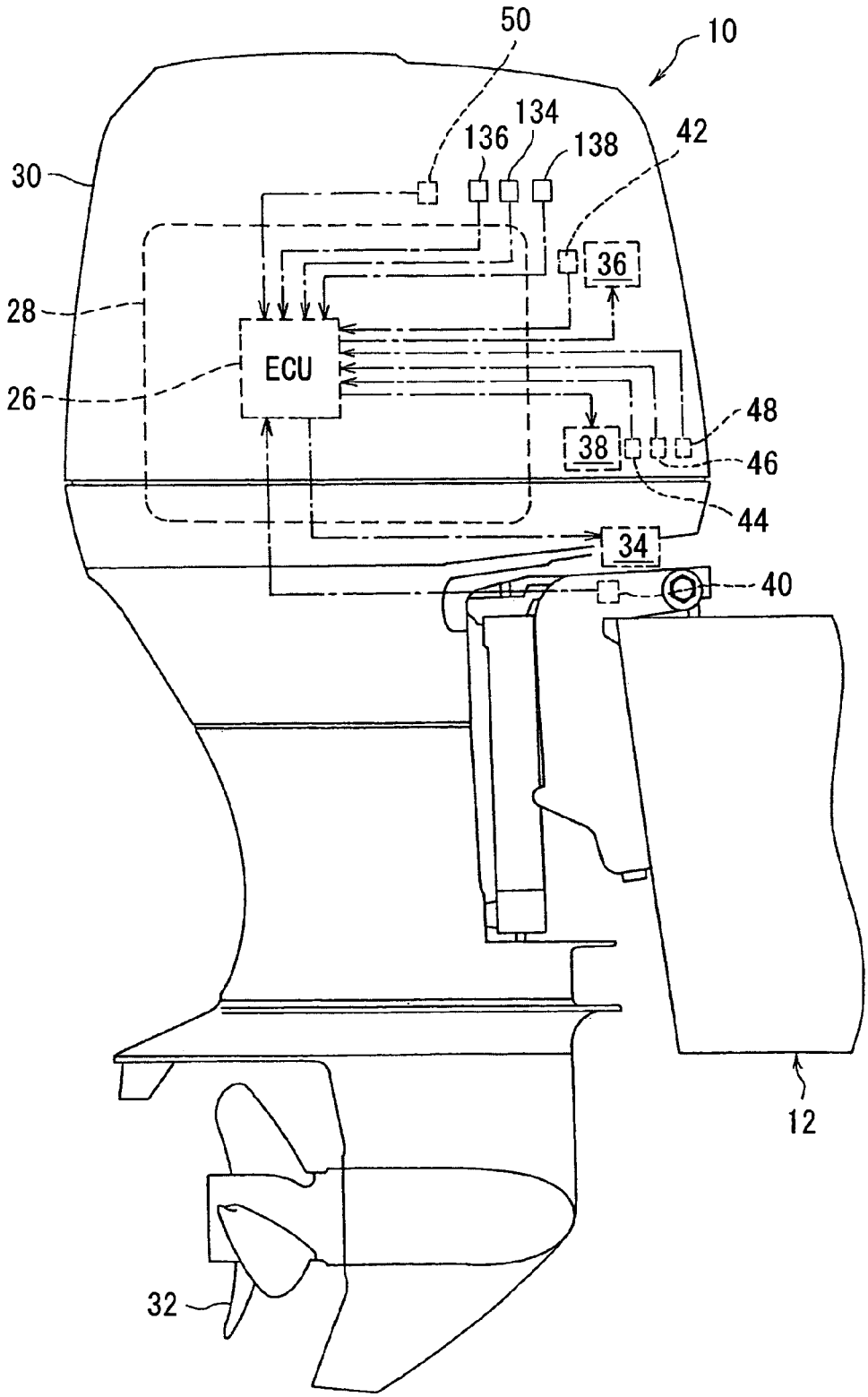
FIG. 13 is a side view of an outboard motor similar to FIG. 2 showing an outboard motor control system according to a third embodiment of the invention.

FIG. 13 is a side view of the outboard motor similar to that of FIG. 2 showing the outboard motor control system according to the third embodiment of the invention.

The third embodiment will be explained with focus on the points of difference from the second embodiment. In the outboard motor shift system according to the third embodiment, the outboard motor 10 is equipped with two operator switches 136, 138 in addition to the operator switch 134. The operator switches 136, 138 are also located to be operable by the operator. In the ensuing description of this embodiment, the operator switch 134 will be referred to as the "first operator switch," the operator switch 136 as the "second operator switch," and the operator switch 138 as the "third operator switch."

As explained regarding the second embodiment, when the first operator switch 134 is operated by the operator, it produces the output indicating that the neutral position has been established by movement of the clutch 102 to the neutral position where it is not in engagement with either the forward gear 98 or the reverse gear 100.

When the second operator switch 136 is operated by the operator, it produces an output (ON signal) indicating that the forward position has been established by movement of the clutch 102 to a position (forward position) where it is in engagement with the forward gear 98. When the third operator switch 138 is operated by the operator, it produces an output (ON signal) indicating that the reverse position has been established by movement of the clutch 102 to a position (reverse position) where it is in engagement with the reverse gear 100. The outputs of the first to third operator switches 134, 136 and 138 are sent to the ECU 26.

The processing operations of the control system according to the third embodiment will now be explained.

Figure 14:
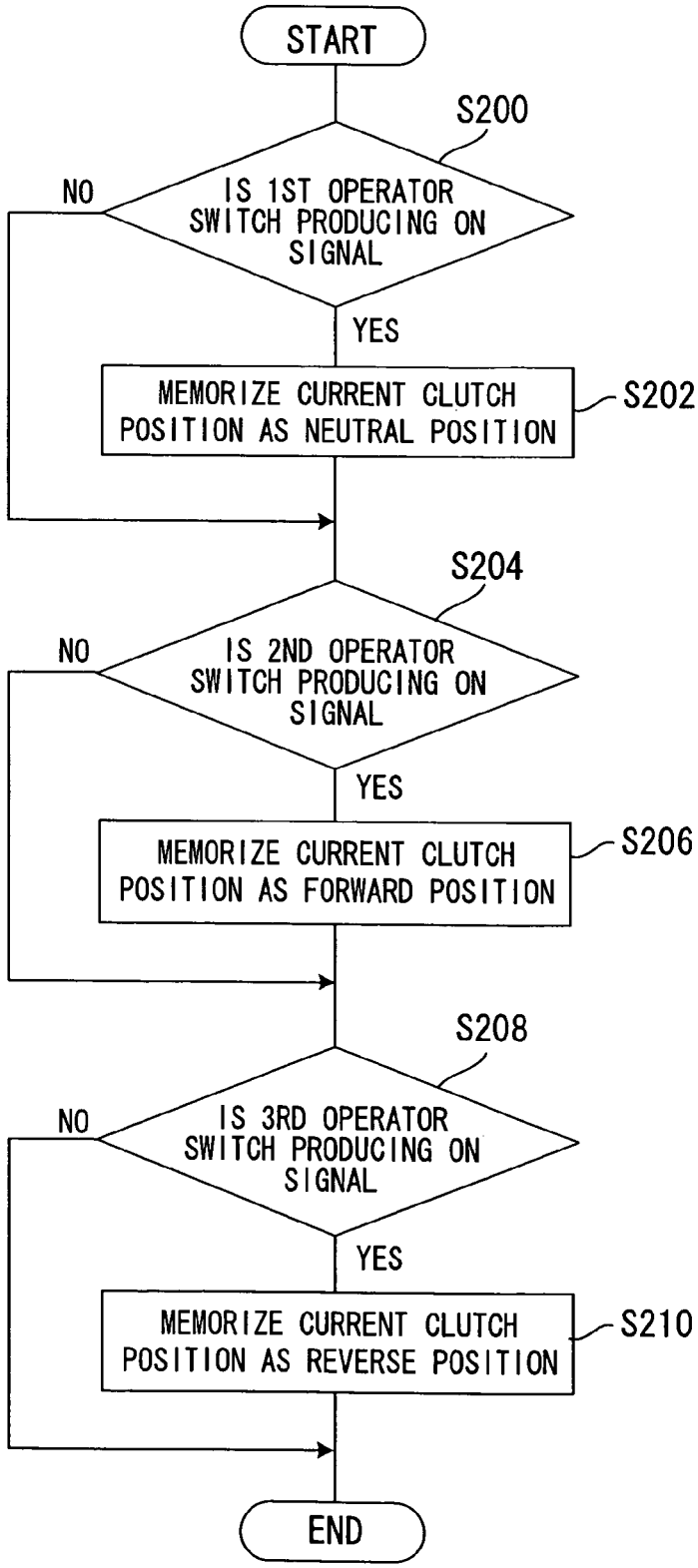
FIG. 14 is a flowchart showing the sequence of the processing operations of the control system according to the third embodiment shown in FIG. 13.

FIG. 14 is a flowchart showing the sequence of the processing operations. The illustrated routine is executed by the ECU 26 at predetermined intervals (e.g., every 10 milliseconds).

First, in S200, it is determined whether the first operator switch 134 is producing an ON signal. When the result in S200 is YES, the program goes to S202, in which, similarly to in S14 of the flowchart of FIG. 10, the current position of the clutch 102 is memorized (stored in memory) as the neutral position. Specifically, the current outputs of the shift position sensors 44, 46 are memorized (stored) in the RAM of the ECU 26 as values indicating the neutral position.

Next, in S204, it is determined whether the second operator switch 136 is producing an ON signal. When the result in S204 is YES, the program goes to S206, in which the current position of the clutch 102 is memorized (stored in memory) as the forward position. Specifically, the current outputs of the shift position sensors 44, 46 are memorized (stored) in the RAM of the ECU 26 as values indicating the forward position.

Next, in S208, it is determined whether the third operator switch 138 is producing an ON signal. When the result in S208 is YES, the program goes to S210, in which the current position of the clutch 102 is memorized (stored in memory) as the reverse position. Specifically, the current outputs of the shift position sensors 44, 46 are memorized (stored) in the RAM of the ECU 26 as values indicating the reverse position.

The operator can therefore store any of the exact neutral position, forward position and reverse position in the ECU 26 by operating the manual lever 132 to establish the shift position and then operating the one of the operator switches 134, 136 and 138 associated with the established position.

When the result in S200, S204 or S208 is NO, the processing of S202, S206 or S210 is skipped.

As explained in the foregoing, the third embodiment of this invention provides an outboard motor control system that uses an actuator (the shift motor 38) to shift the clutch 102 to a position where it engages with either the forward gear 98 or the reverse gear 100, or a neutral position, thereby changing the shift position of the outboard motor 10 between forward, neutral and reverse, which outboard motor control system comprises: a manual shift mechanism (the manual lever 132) operable by the operator for shifting the clutch 102; the first operator switch 134 located to be operable by the operator that when operated produces an output (ON signal) indicating that the neutral position has been established by movement of the clutch 102 to a position where it is not in engagement with either the forward gear 98 or the reverse gear 100; neutral position memorizer (the ECU 26, S202 in the flowchart of FIG. 14) for memorizing or storing as the neutral position the position of the clutch 102 when the first operator switch 134 produces the aforesaid output; the second operator switch 136 located to be operable by the operator that when operated produces an output (ON signal) indicating that the forward position has been established by movement of the clutch 102 to a position where it is in engagement with the forward gear 98; forward position memorizer (the ECU 26, S206 in the flowchart of FIG. 14) for memorizing or storing as the forward position the position of the clutch 102 when the second operator switch 136 produces the aforesaid output; the third operator switch 138 located to be operable by the operator that when operated produces an output (ON signal) indicating that the reverse position has been established by movement of the clutch 102 to a position where it is in engagement with the reverse gear 100; and reverse position memorizer (the ECU 26, S210 in the flowchart of FIG. 14) for memorizing or storing as the reverse position the position of the clutch 102 when the third operator switch 138 produces the aforesaid output.

Similarly to in the first and second embodiments, the so-configured third embodiment also enables the clutch 102 to be accurately shifted to the positions where the forward, neutral and reverse shift positions are established, thereby preventing shifting errors.

Although the actuator for shifting the clutch 102 is exemplified as an electric motor in the foregoing description, it can instead be a hydraulic cylinder or any of various other kinds of actuator.

Although the angles of rotation of the rotary shaft 110*m* and rotary shaft 110*n* of the speed reduction gear mechanism 110 are detected as the values indicating the position of the clutch 102 in the foregoing embodiments, it is possible instead to directly detect the position of the clutch 102 or to detect the angle of rotation of the shift rod 106 or the like.

In the second and third embodiments, it is possible to provide a switch for disabling the operation of the operator switches 134, 136, 138 so as to prevent unintended storage in memory of the neutral position, forward position and reverse position.

An outboard motor control system according to a fourth embodiment of the invention will now be explained with reference to the attached drawings.

Figure 15:
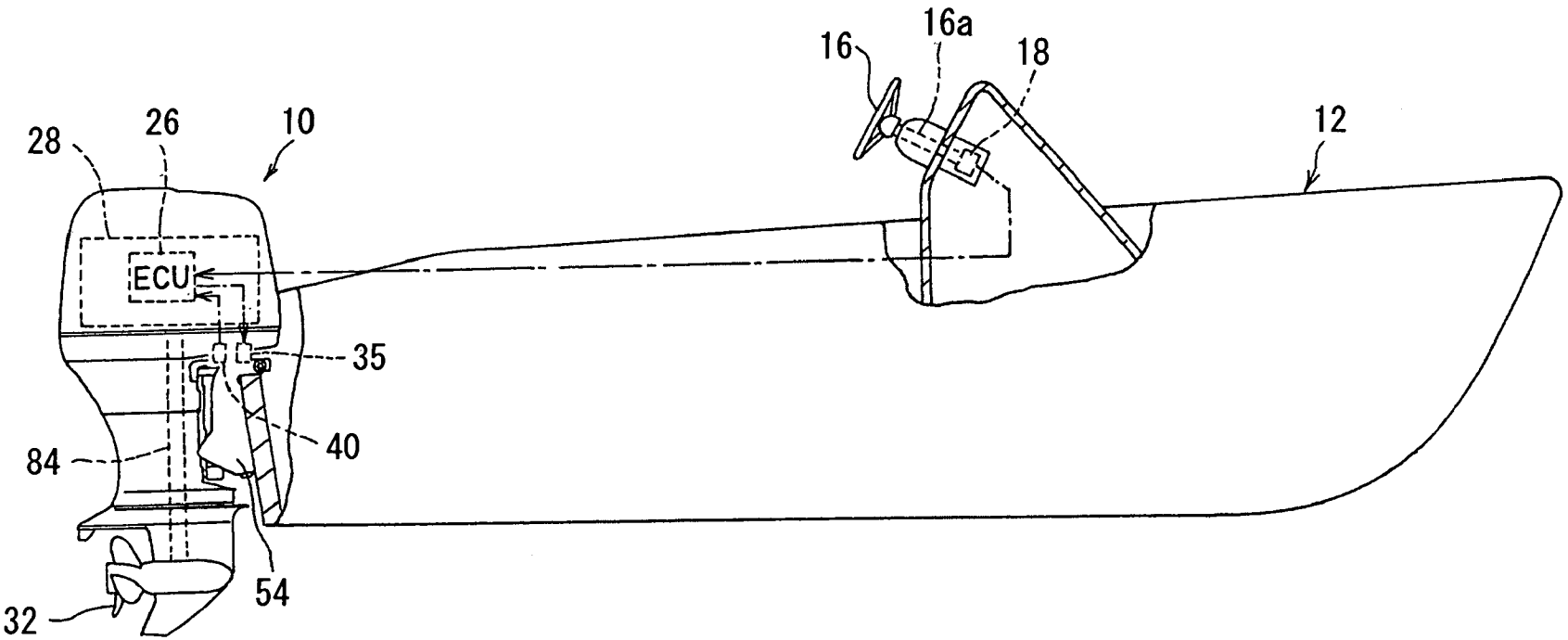
FIG. 15 is an overall schematic view of an outboard motor control system according to a fourth embodiment of the invention.
Figure 16:
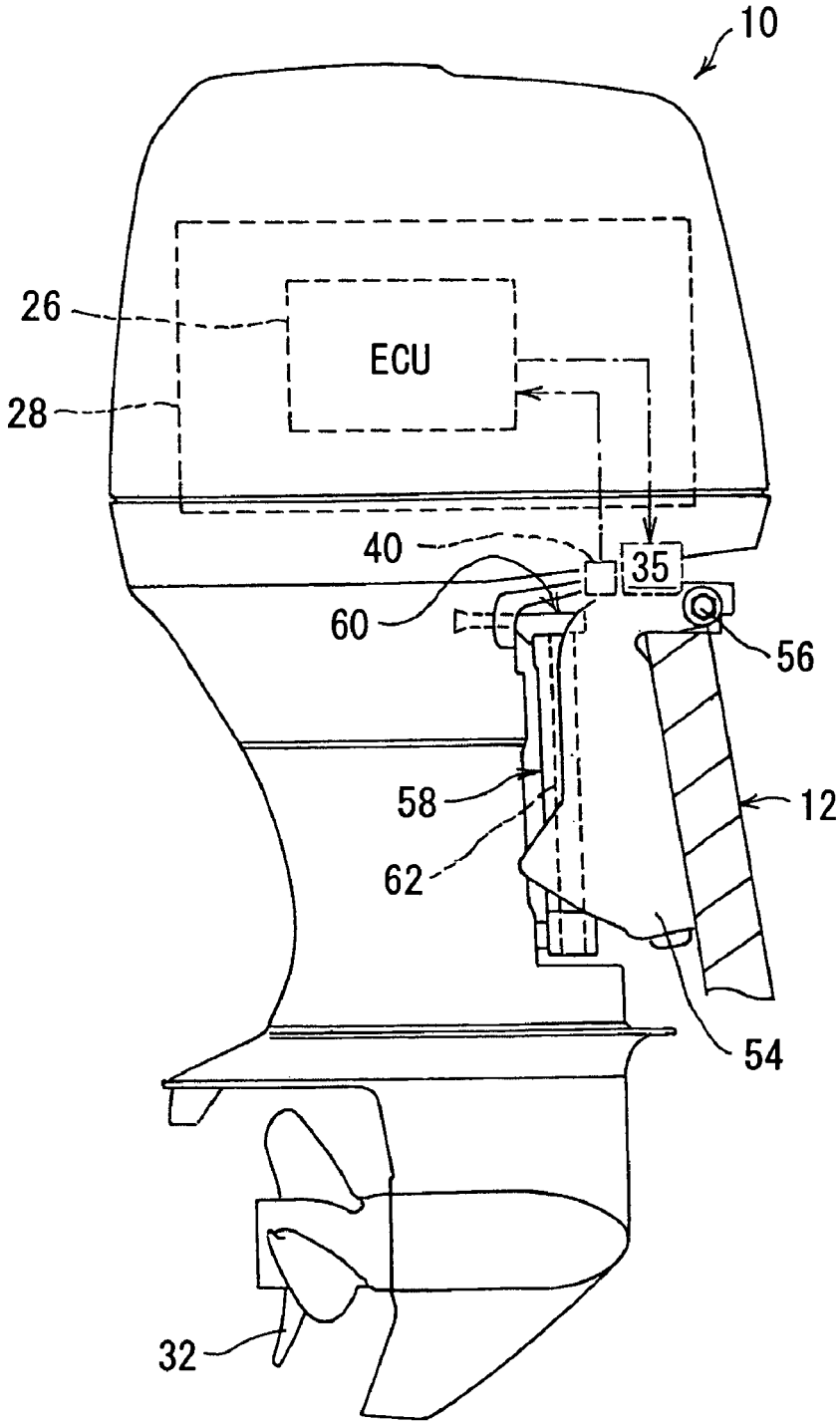
FIG. 16 is an enlarged side view of an outboard motor shown in FIG. 15.
Figure 17:
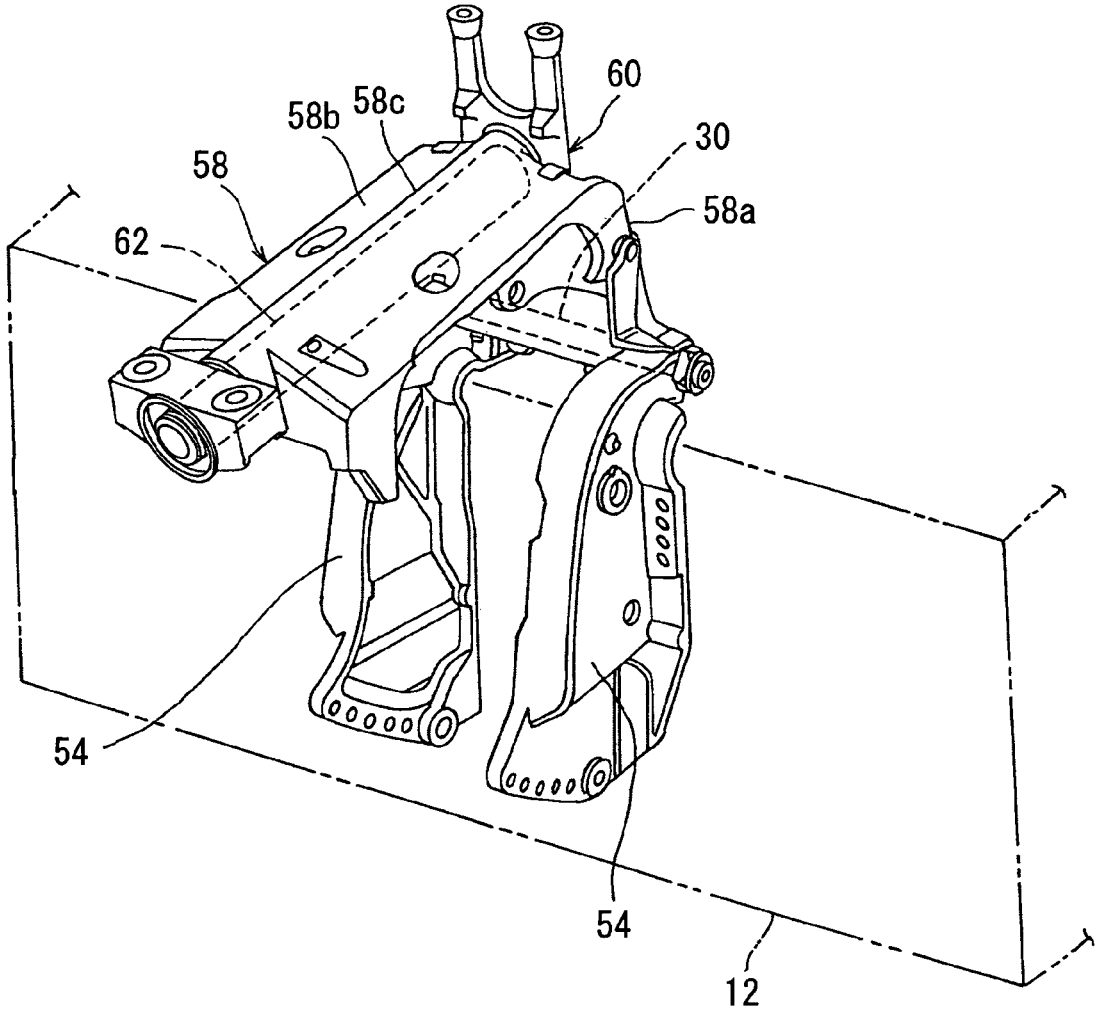
FIG. 17 is an enlarged perspective view of stern brackets, a swivel case and a mount frame shown in FIG. 16.

FIG. 15 is an overall schematic view of the outboard motor control system according to the fourth embodiment of the invention. FIG. 16 is an enlarged side view of the outboard motor shown in FIG. 15. FIG. 17 is an enlarged perspective view of the stern brackets 54, swivel case 58 and mount frame 60 shown in FIG. 16. The swivel case 58 is shown in FIG. 17 in its orientation when the outboard motor 10 is tilted up.

As shown in FIG. 17, the swivel case 58 includes a horizontal section 58*a* that lies parallel to the horizontal direction when the outboard motor 10 is tilted down and a vertical section 58*b* extending vertically downward from the horizontal section 58*a*. The vertical section 58*b* of the swivel case 58 is formed with a cylindrical portion 58*c*. The axial direction of the cylindrical portion 58*c* lies parallel to the vertical axis. The tilting shaft 56 is inserted into the horizontal section 58*a* near its forward end. The axial direction of the tilting shaft 56 lies parallel to the lateral axis.

The stern brackets 54 are provided one on either lateral side of the swivel case 58. The swivel case 58 is connected to the two stern brackets 54 through the tilting shaft 56 to be rotatable about the lateral axis. An actuator, e.g., a hydraulic cylinder for tilting and trimming the outboard motor 10 up and down is installed between the two stern brackets 54 but is omitted in the drawing to make the overall structure easier to understand.

As shown in FIGS. 16 and 17, the mount frame 60 is equipped with the shaft member 62. The shaft member 62 is accommodated in the cylindrical portion 58*c* of the swivel case 58 to be rotatable about the vertical axis.

Owing to this structure, the outboard motor 10, more exactly, the outboard motor main unit can be tilted and trimmed up and down about the tilting shaft 56 as the axis of rotation, and the shaft member 62 can be turned laterally (around the vertical axis) as the rudder shaft.

As shown in FIG. 16, a hydraulic cylinder 35 and the rudder angle sensor 40 are installed above the swivel case 58. Like the steering motor 34, the hydraulic cylinder 35 functions as an actuator for driving the shaft member 62. The rudder angle sensor 40 produces an output indicating the rudder angle of the outboard motor 10. The output of the rudder angle sensor 40 is sent to the ECU 26.

Figure 18:
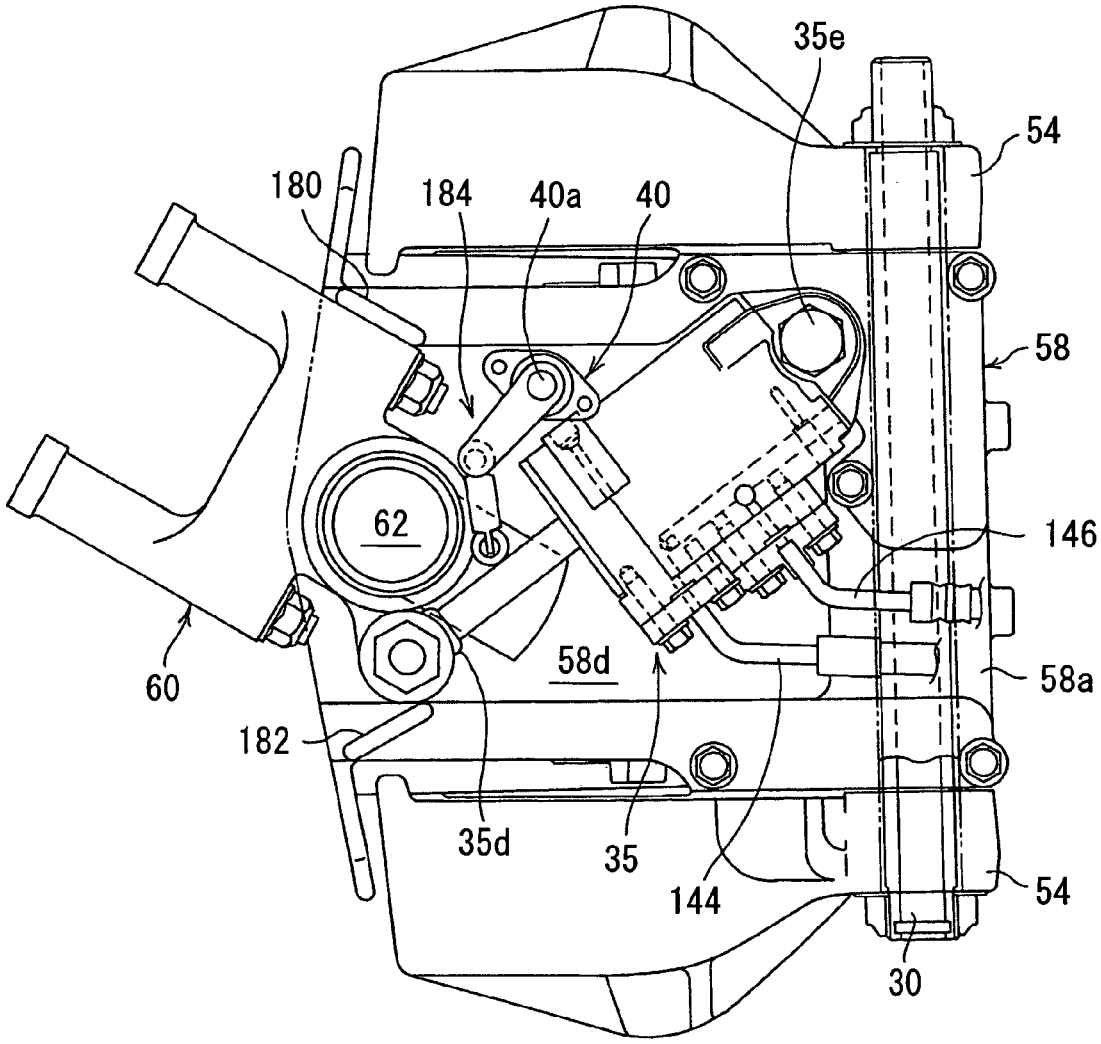
FIG. 18 is an enlarged plan view of the swivel case etc. shown in FIG. 17.
Figure 19:
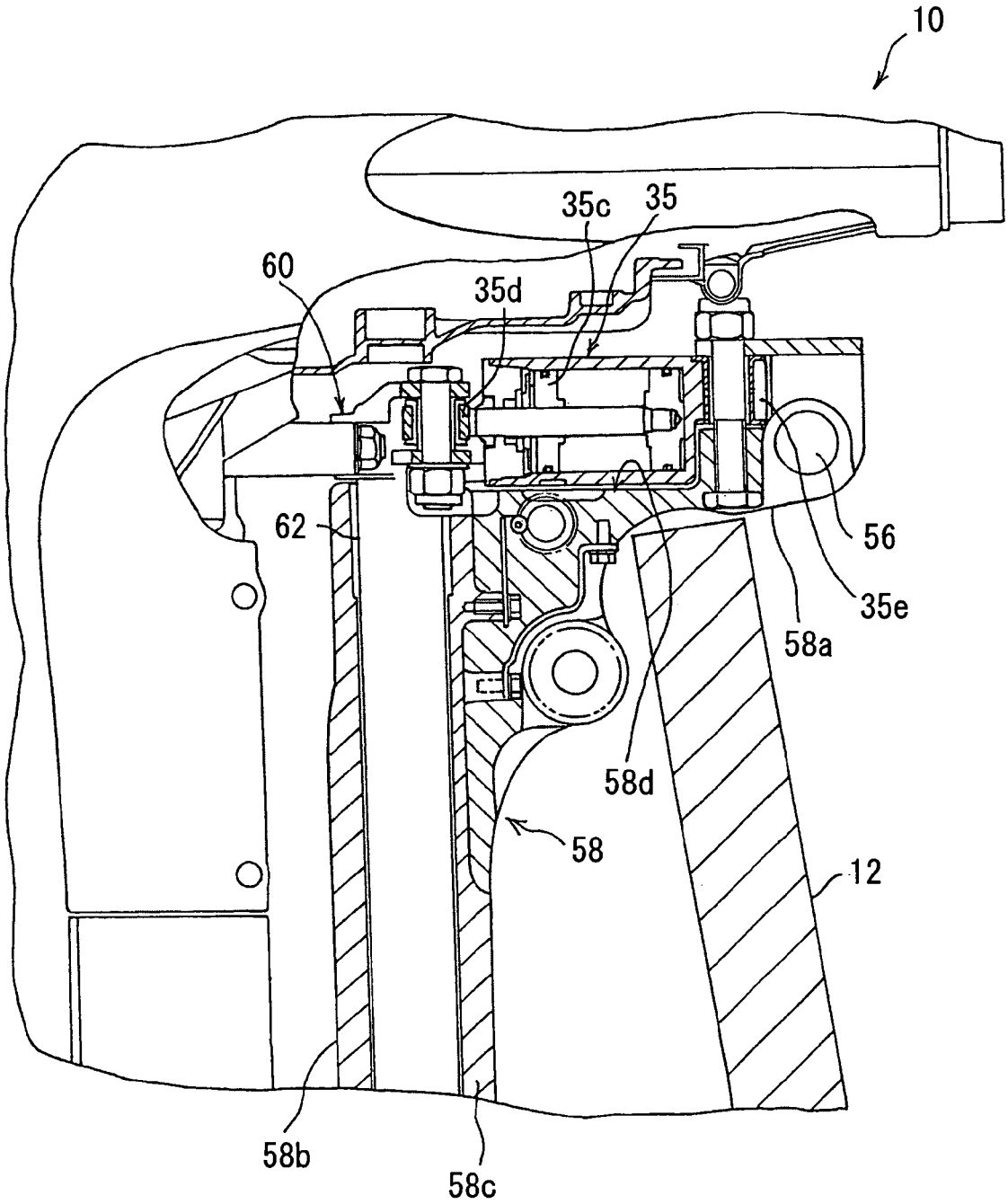
FIG. 19 is a sectional side view of the swivel case etc. shown in FIG. 18.

FIG. 18 is an enlarged plan view of the swivel case 58 shown in FIG. 17. FIG. 19 is a sectional side view of the swivel case 58 shown in FIG. 18 and other members.

As shown in FIGS. 18 and 19, the hydraulic cylinder 35 is installed on the upper surface 58*d* of the swivel case 58 (on the upper surface of the horizontal section 58*a* thereof). The hydraulic cylinder 35 is a reciprocating cylinder. It is supplied with operating fluid from a hydraulic circuit (explained below) through two oil lines 144, 146.

Figure 20:
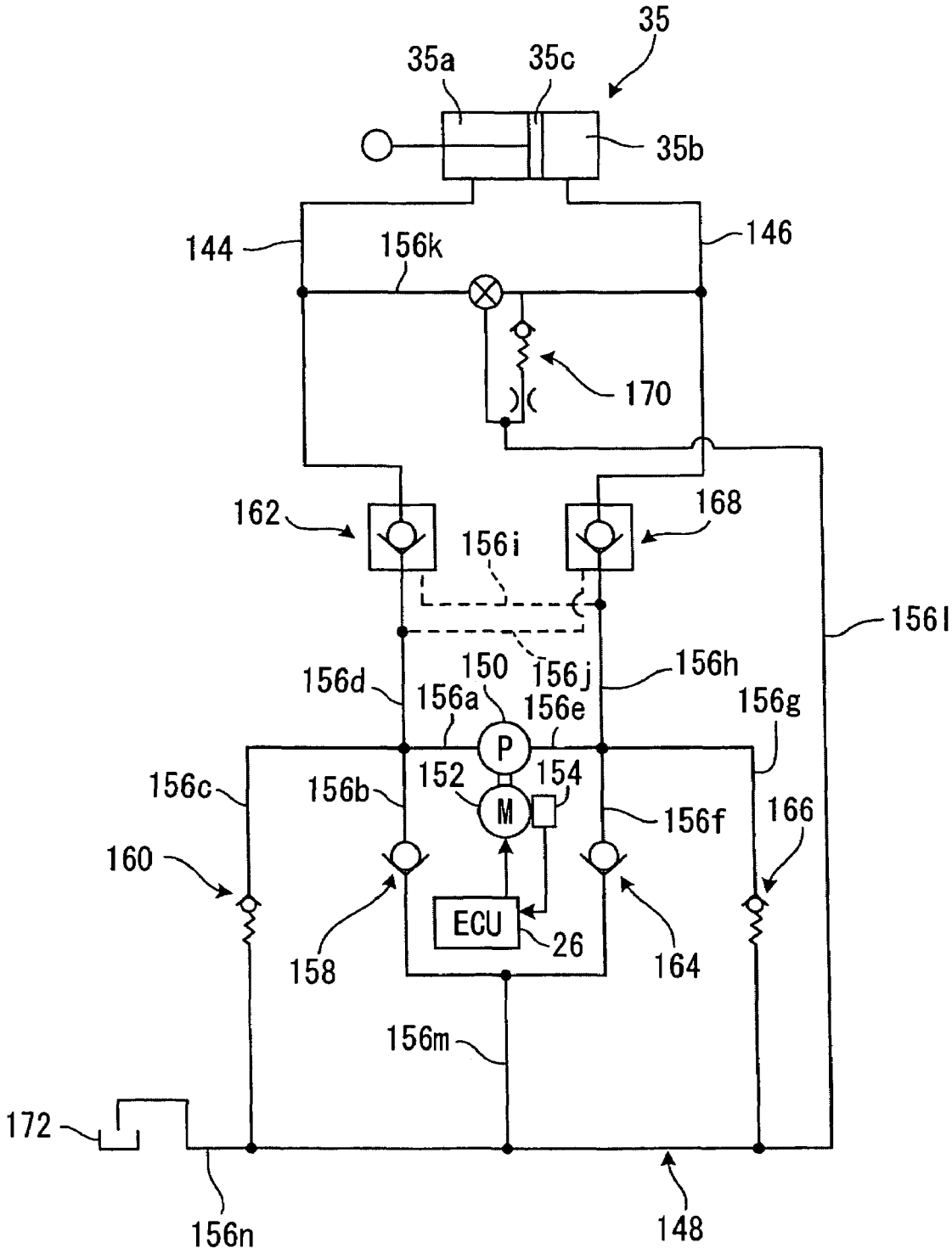
FIG. 20 is a circuit diagram representing a hydraulic circuit connected to a hydraulic cylinder shown in FIG. 18.

FIG. 20 is a circuit diagram representing the hydraulic circuit connected to the hydraulic cylinder 35.

As shown in FIG. 20, the hydraulic circuit (now assigned with symbol 148) is equipped with a hydraulic pump 150 and an electric motor 152 for driving the hydraulic pump 150. The electric motor 152 is connected to and supplied with drive current by the ECU 26. A current sensor 154 is provided in the energizing circuit of the motor 152. The current sensor 154 produces an output indicating the drive current of the motor 152. The output of the current sensor 154 is sent to the ECU 26.

An oil line 156*a* is connected to one end of the hydraulic pump 150. The oil line 156*a* branches into three oil lines 156*b*, 156*c* and 156*d*. A first check valve 158 is disposed in the oil line 156*b* and a first relief valve 160 is disposed in the oil line 156*c*.

A first switching valve 162 for switching the direction of operating fluid flow is connected to the oil line 156*d*. The first switching valve 162 is constituted as a pilot check valve whose primary side is connected to the oil line 156*d* and secondary side is connected through the oil line 144 to a first oil chamber 35*a* of the hydraulic cylinder 35. An oil line 156*e* is connected to the other end of the hydraulic pump 150. The oil line 156*e* branches into three oil lines 156*f*, 156*g* and 156*h*. A second check valve 164 is disposed in the oil line 156*f* and a second relief valve 166 is disposed in the oil line 156*g*. A second switching valve 168 is connected to the oil line 156*h*. Like the first switching valve 162, the second switching valve 168 is also constituted as a pilot check valve. Its primary side is connected to the oil line 156*h* and secondary side is connected through the oil line 146 to a second oil chamber 35*b* of the hydraulic cylinder 35. The pilot side of the first switching valve 162 is connected through an oil line 156*i* to the oil line 156*h*. The pilot side of the second switching valve 168 is connected through an oil line 156*j* to the oil line 156*d*.

The oil line 144 and oil line 146 are interconnected through an oil line 156*k*. A manual valve with attached thermal valve (manual steering mechanism; hereinafter called simply "manual valve") 170 provided in the oil line 156*k* connects the oil line 156*k* to an oil line 1561. The manual valve 170 is located at a position where the operator can manipulate. The oil line 156*b* and oil line 156*f* merge to form an oil line 156*m*. The oil line 156*c*, oil line 156*g*, oil line 1561 and oil line 156*m* are connected to a reserve tank 172 through an oil line 156*n*.

When the operation of the motor 152 is controlled to deliver operating fluid from the hydraulic pump 150 into the oil line 156*a*, operating fluid stored in the reserve tank 172 passes through the oil line 156*n*, oil line 156*m*, oil line 156*f*, second check valve 164, oil line 156*e*, hydraulic pump 150, oil line 156*a*, oil line 156*d*, first switching valve 162 and oil line 144 to be supplied to the first oil chamber 35*a* of the hydraulic cylinder 35.

When greater than a predetermined hydraulic pressure is applied through the oil line 156*j* to the pilot side of the second switching valve 168, the second switching valve 168 communicates the oil line 146 with the oil line 156*h* to pass operating fluid into the second oil chamber 35*b*. As a result, the piston 35*c* of the hydraulic cylinder 35 is driven to the right in the drawing sheet (pull direction).

On the other hand, when the operation of the motor 152 is controlled to deliver operating fluid from the hydraulic pump 150 into the oil line 156*e*, operating fluid stored in the reserve tank 172 passes through the oil line 156*n*, oil line 156*m*, oil line 156*b*, first check valve 158, oil line 156*a*, hydraulic pump 150, oil line 156*e*, oil line 156*h*, second switching valve 168 and oil line 146 to be supplied to the second oil chamber 35*b* of the hydraulic cylinder 35.

At this time, when greater than a predetermined hydraulic pressure is applied through the oil line 156*i* to the pilot side of the first switching valve 162, the first switching valve 162 communicates the oil line 144 with the oil line 156*d* to pass operating fluid into the first oil chamber 35*a*. As a result, the piston 35*c* of the hydraulic cylinder 35 is driven to the left in the drawing sheet (push direction).

When the supply of operating fluid to the hydraulic cylinder 35 is terminated, the first switching valve 162 and second switching valve 168 respectively shut off communication of the oil line 156*d* with the oil line 144 and communication of the oil line 156*h* with the oil line 146, thereby preventing operating fluid supplied to the first and second oil chambers 35*a*, 35*b* from flowing out so as to retain the position of the piston 35*c* (to latch the rudder angle of the outboard motor 10).

When the manual valve 170 is opened, the oil chambers 35*a*, 35*b* of the hydraulic cylinder 35 are communicated with the reserve tank 172 through the oil line 144, oil line 146, oil line 156*k*, oil line 156*l* and oil line 156*n*. The operator can therefore enable manual steering of the outboard motor 10 by opening the manual valve 170. When the temperature of the operating fluid rises above a predetermined value, the thermal valve associated with the manual valve 170 automatically opens to return operating fluid to the reserve tank 172.

The explanation of FIGS. 18 and 19 will be resumed. A rod head 35*d* of the hydraulic cylinder 35 is connected to the shaft member 62, and a cylinder bottom 35*e* is connected to the upper surface 58*d* of the swivel case 58. Movement of the piston 35*c* of the hydraulic cylinder 35 turns the outboard motor 10 (outboard motor main unit) leftward or rightward around the shaft member 62 as the rudder turning axis. In this specification, the rudder turning direction when the propeller 32 moves to the left as viewed from behind relative to boat forward travel is called leftward and that when the propeller 32 is moved to the right is called rightward. In FIG. 18, the outboard motor 10 is turned leftward.

Figure 21:
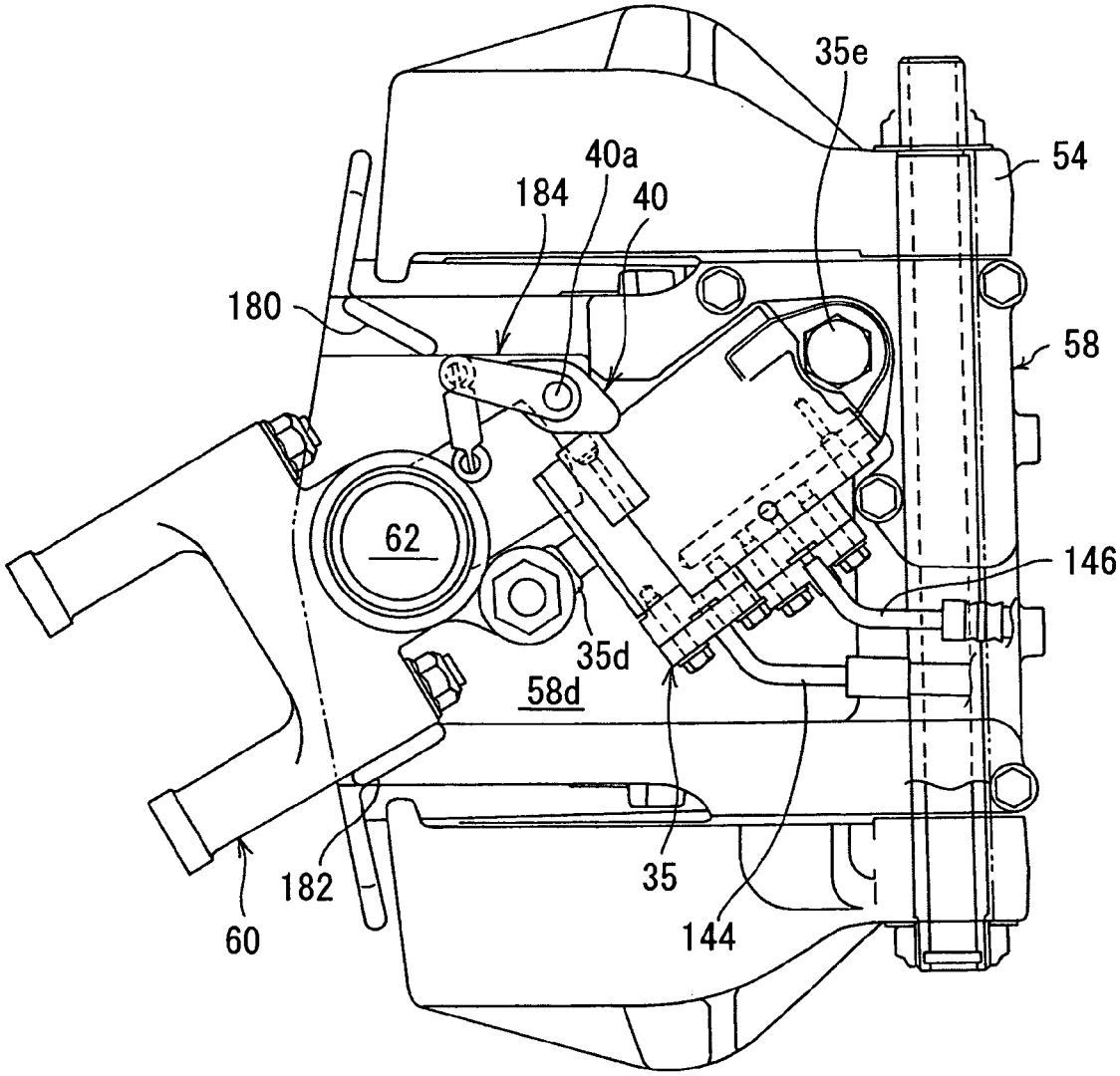
FIG. 21 is an enlarged plan view of the swivel case etc. similar to FIG. 18.

A left steer stop 180 and a right steer stop 182 are formed on the upper surface 58*d* of the swivel case 58. As shown in FIG. 18, when the outboard motor 10 turns leftward (when the hydraulic cylinder 35 is driven in the push direction), the mount frame 60 hits the left steer stop 180, thereby mechanically stopping the leftward turning of the outboard motor 10. On the other hand, as shown in FIG. 21, when the outboard motor 10 turns rightward (when the hydraulic cylinder 35 is driven in the pull direction), the mount frame 60 hits the right steer stop 182, thereby mechanically stopping the rightward turning of the outboard motor 10. In other words, the locations of the left steer stop 180 and right steer stop 182 are design factors that determine the values of the maximum leftward rudder angle and the maximum rightward rudder angle of the outboard motor 10. This embodiment is designed to make both the maximum leftward rudder angle and the maximum rightward rudder angle 30°.

The rudder angle sensor 40 is disposed on the upper surface 58*d* of the swivel case 58. A detector element 40*a* of the rudder angle sensor 40 is connected to the shaft member 62 through a linkage 184. The rudder angle sensor 40 detects the rotation angle of the shaft member 62 transmitted to the detector element 40*a* through the linkage 184 as the rudder angle of the outboard motor 10.

Returning to the explanation of FIG. 15, the steering wheel 16 installed near the operator's seat of the boat 12 turns lock-to-lock in three revolutions.

In the fourth embodiment, based on the inputted sensor outputs, the ECU 26 determines or defines desired values for use in control when the outboard motor 10 is steered to the maximum rudder angles or the neutral rudder angle.

Figure 22:
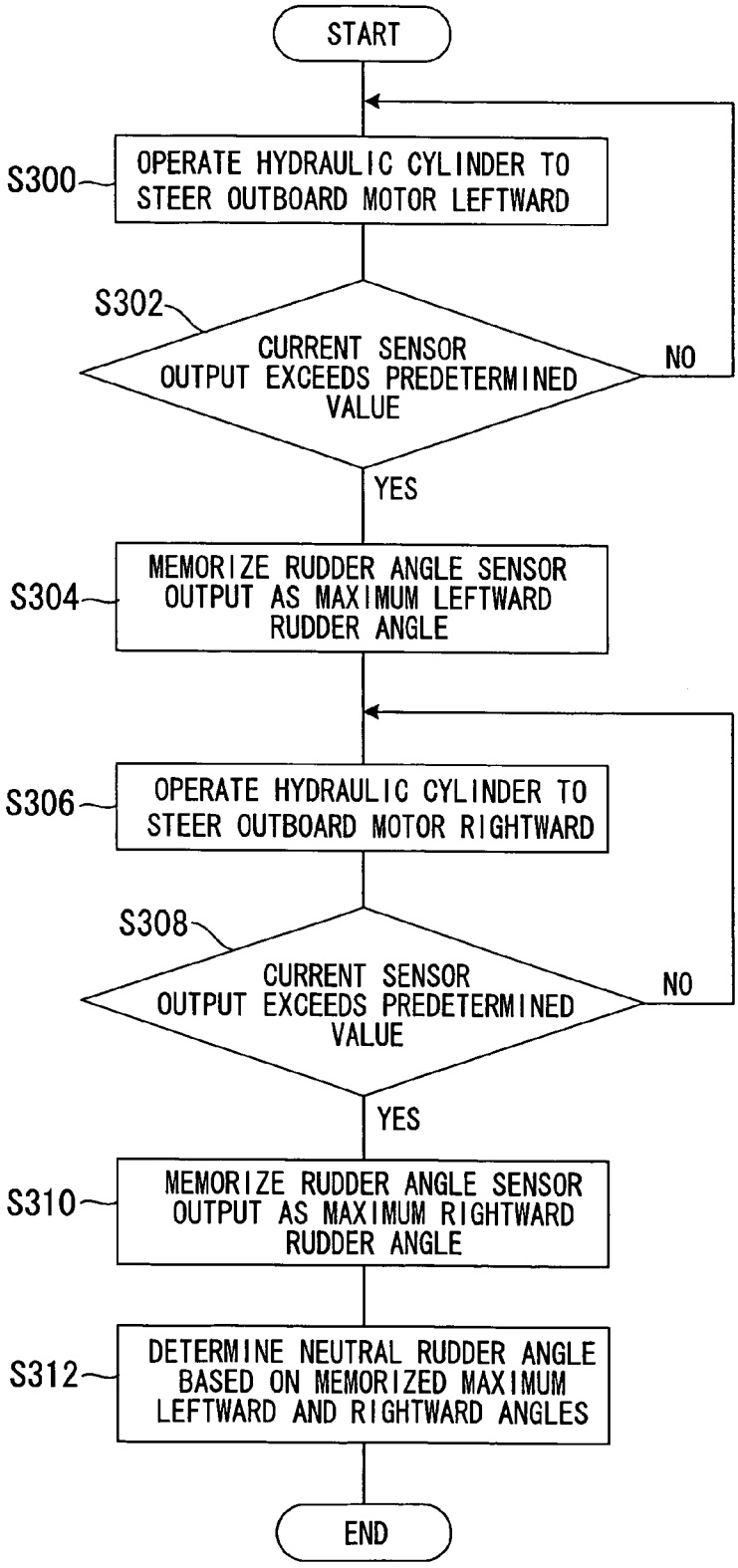
FIG. 22 is a flowchart showing the sequence of the processing operations of the control system according to the fourth embodiment shown in FIG. 15.

FIG. 22 is a flowchart showing the sequence of the processing operations of the control system according to the fourth embodiment. The illustrated routine is executed at each starting of the outboard motor 10.

First, in S300, the hydraulic cylinder 35 is operated (the operation of the motor 152 is controlled) to steer the outboard motor 10 leftward. Next, in S302, it is determined whether the output of the current sensor 154 exceeds a predetermined value.

When leftward steering of the outboard motor 10 is mechanically stopped by the mount frame 60 hitting the left steer stop 180, the load on the motor 152 increases to increase the drive current. So if in S302 the output of the current sensor 154 is found to exceed the predetermined value (increase in the drive current is detected), this means that the outboard motor 10 has been steered to the maximum leftward rudder angle.

When the result in S302 is NO, the program returns to S300, and when it is YES, the program goes to S304, in which the output of the rudder angle sensor 40 at that time is memorized (stored) in the RAM (not shown) of the ECU 26 as indicating the maximum leftward rudder angle.

Next, in S306, the operation of the hydraulic cylinder 35 is controlled to steer the outboard motor 10 rightward. Then, in S308, it is determined whether the output of the current sensor 154 exceeds a predetermined value, i.e. whether rightward steering of the outboard motor 10 has been mechanically stopped by the right steer stop 182. When the result in S308 is NO, the program returns to S306, and when it is YES, the program goes to S310, in which the output of the rudder angle sensor 40 at that time is memorized (stored) in the RAM of the ECU 26 as indicating the maximum rightward rudder angle.

Next, in S312, the neutral rudder angle is determined or defined based on the maximum leftward rudder angle and maximum rightward rudder angle memorized (stored in memory). The neutral rudder angle is the rudder angle of the outboard motor 10 during straight forward travel of the boat 12 and is therefore 0°.

Specifically, the value obtained by averaging the maximum leftward rudder angle and maximum rightward rudder angle stored in memory is determined or defined as the neutral rudder angle. Therefore, in the case where, for example, the actual values of the maximum leftward rudder angle and maximum rightward rudder angle are 300 and −30° (rudder angles leftward of the neutral rudder angle being determined (defined) as positive and those rightward thereof as negative) but the maximum leftward rudder angle and maximum rightward rudder angle stored in memory are nevertheless 31° and −29°, i.e., when the output of the rudder angle sensor 40 has drifted 1° in the leftward rudder angle direction, the neutral rudder angle is determined taking the drift into account (={31+(−29)}/2).

When the steering wheel 16 is turned to the maximum leftward steering angle, the ECU 26 determines or defines the maximum leftward rudder angle stored in memory (or a value slightly closer to the neutral rudder angle) as the desired value for control purposes and controls the operation of the hydraulic cylinder 35 so as to make the output of the rudder angle sensor 40 equal to the determined desired value, thereby steering the outboard motor 10 to the maximum leftward rudder angle.

Similarly, when the steering wheel 16 is turned to the maximum rightward steering angle, the ECU 26 determines or defines the maximum rightward rudder angle stored in memory (or a value slightly closer to the neutral rudder angle) as the desired value and controls the operation of the hydraulic cylinder 35. When the steering wheel 16 is steered to the neutral steering angle (steering angle of 0°), the ECU 26 determines or defines the defined neutral rudder angle as the desired value.

Desired values are also determined or defined based on the aforesaid stored (defined) maximum rudder angles and the neutral rudder angle in cases where the steering wheel 16 is steered to steering angles between the maximum steering angles and the neutral steering angle. When, as in the example above, the maximum leftward rudder angle and maximum rightward rudder angle stored in memory are 31° and −29°, the total rudder angle range of the outboard motor 10 is 60°. Since, as is pointed out above, the steering wheel 16 turns lock-to-lock in three revolutions, i.e., has a total steering angle range of 1,080°, it follows that in this case the desired value increases or decreases by 1° per 18° (=1,080/60) turning of the steering wheel 16. Therefore, when the steering wheel 16 is, for example, turned 360° leftward from the neutral steering angle, the desired value is determined or defined as 21°, which is the value obtained by adding 20° (=360/18) to the neutral rudder angle (=1°). The desired value (21°) can also be derived by subtracting 10° (={540−360}/18) from the maximum leftward rudder angle (=31°).

As explained in the foregoing, the fourth embodiment of this invention provides an outboard motor control system that steers the outboard motor 10 leftward and rightward using the hydraulic cylinder (actuator) 35, which outboard motor control system comprises: the left steer stop 180 for mechanically stopping leftward steering of the outboard motor 10; the right steer stop 182 for mechanically stopping rightward steering of the outboard motor 10; the rudder angle sensor 40 for producing an output indicating the rudder angle of the outboard motor 10; and maximum rudder angle memorizer (the ECU 26, S304, S310) for memorizing (storing) the output of the rudder angle sensor 40 in memory as the maximum leftward rudder angle of the outboard motor 10 when the outboard motor 10 is mechanically stopped by the left steer stop 180 and memorizing (storing) the output of the rudder angle sensor 40 in memory as the maximum rightward rudder angle of the outboard motor 10 when the outboard motor 10 is mechanically stopped by the right steer stop 182.

Owing to this configuration, the desired values for control purposes when steering the outboard motor 10 to the maximum rudder angles can be determined or defined as values that take the unit-specific properties of the outboard motor 10 into account. As a result, the rudder angle of the outboard motor 10 can be regulated to the maximum rudder angles with good accuracy, thereby preventing degradation of turning performance owing to insufficient rudder angle and interference between constituent members owing to excessive rudder angle.

Moreover, the outboard motor control system according to the fourth embodiment is configured to further comprise neutral rudder angle determiner (the ECU 26, S312) for determining or defining the average value of the maximum leftward rudder angle and maximum rightward rudder angle memorized (stored in memory) as the neutral rudder angle. The desired value for control purposes when steering the outboard motor 10 to the neutral rudder angle can therefore be determined or defined as a value that takes the unit-specific properties of the outboard motor 10 into account. As a result, the rudder angle of the outboard motor 10 can be regulated to the neutral rudder angle with good accuracy, thereby enhancing straight course-holding performance.

Although it is explained in the foregoing that desired values (desired values for control purposes when steering the outboard motor 10 to a maximum rudder angle or the neutral rudder angle) are determined every time the outboard motor 10 is started, it is instead possible, for example, to determine them only once upon completion of the assembly of the outboard motor 10 or define them only when the outboard motor 10 is started after elapse of a predetermined period from the last time it was operated.

An outboard motor control system according to a fifth embodiment of the invention will now be explained.

Figure 23:
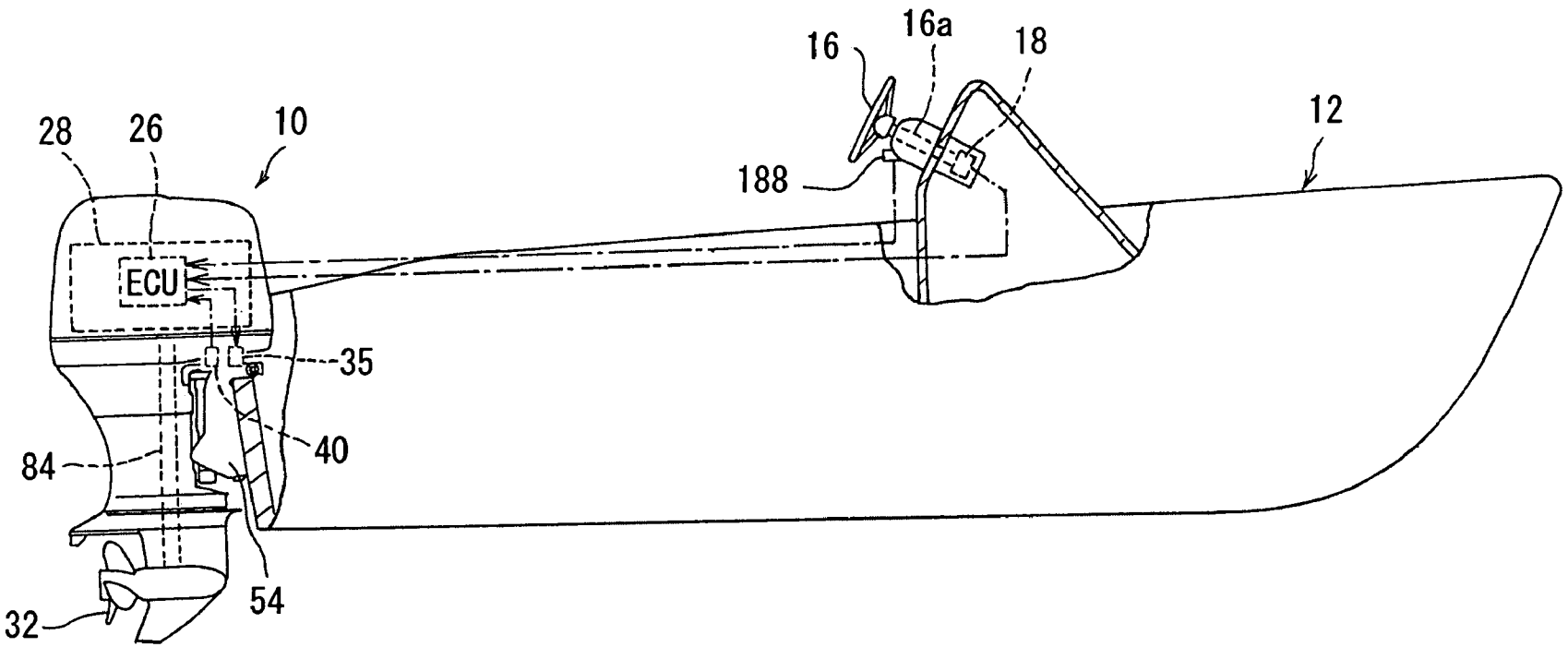
FIG. 23 is an overall schematic view similar to FIG. 15 showing an outboard motor control system according to a fifth embodiment of the invention.

FIG. 23 is a schematic view similar to FIG. 15 showing an outboard motor control system according to the fifth embodiment of the invention.

The fifth embodiment will be explained with focus on the points of difference from the fourth embodiment. As shown FIG. 23, the fifth embodiment is provided near the operator's seat of the boat 12 with a desired-value-set switch 188. The desired-value-set switch 188 is located to be operable by the operator. When the desired-value-set switch 188 is operated, it produces a predetermined output (ON signal). The output of the desired-value-set switch 188 is sent to the ECU 26.

Figure 24:
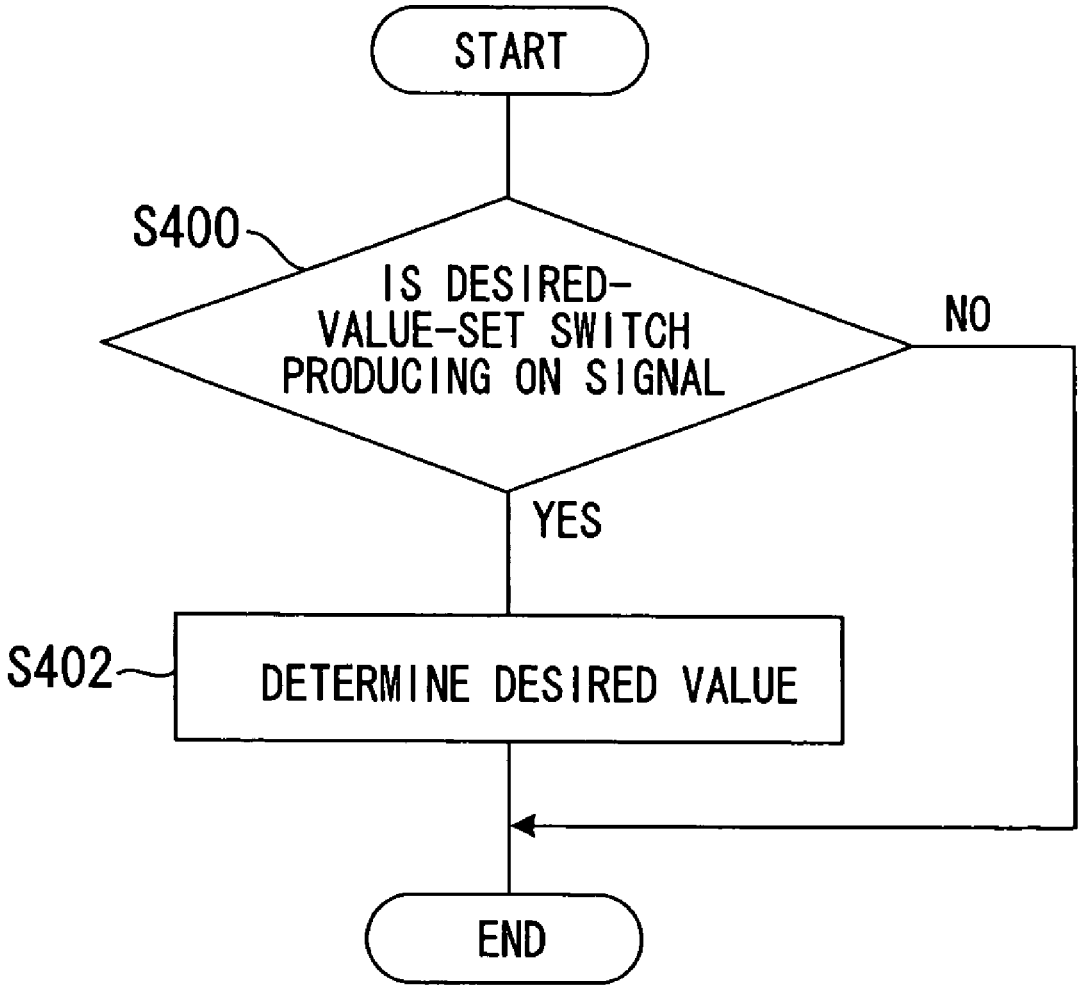
FIG. 24 is a flowchart showing the sequence of the processing operations of the control system according to the fifth embodiment shown in FIG. 23.

FIG. 24 is a flowchart showing the sequence of the processing operations executed by the outboard motor control system according to the fifth embodiment for determining or defining a desired value (desired value for control purposes when steering the outboard motor 10 to a maximum rudder angle or the neutral rudder angle). The illustrated routine is executed by the ECU 26 at predetermined intervals (e.g., every 10 milliseconds).

In S400 of the flowchart of FIG. 24, it is determined whether the desired-value-set switch 188 is producing an ON signal. When the result in S400 is YES, the program goes to S402, in which processing for determining or defining the desired value (desired value for control purposes when steering the outboard motor 10 to a maximum rudder angle or the neutral rudder angle) is executed. This processing is the same as that of the flowchart of FIG. 22 explained above with respect to the fourth embodiment. When the result in S400 is NO, S402 is skipped.

Owing to this configuration, the outboard motor control system according to the fifth embodiment of the invention enables the desired values to be determined not only at starting of the outboard motor 10 but also at other times. Since the processing for determining or defining the desired values involves setting the outboard motor to the maximum rudder angles, it may impair the safety of the boat when it is being operated. This problem can be overcome by enabling operation of the desired-value-set switch 188 only when the boat speed detected by a boat speed sensor (not shown) is zero or a very low speed.

An outboard motor control system according to a sixth embodiment of the invention will now be explained.

Figure 25:
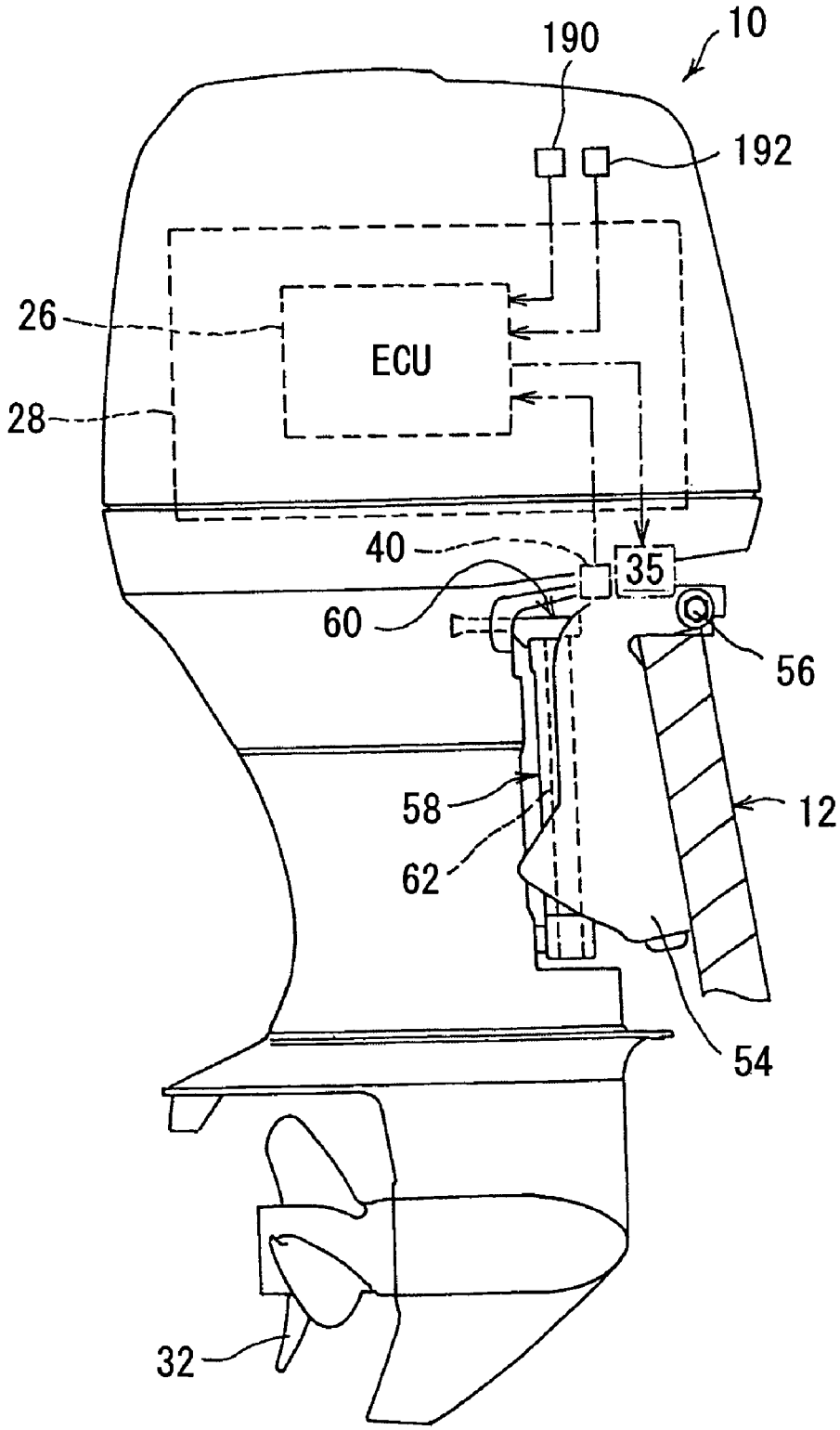
FIG. 25 is a side view similar to FIG. 16 showing an outboard motor control system according to a sixth embodiment of the invention.

FIG. 25 is a side view similar to FIG. 16 showing an outboard motor control system according to the sixth embodiment of the invention.

The sixth embodiment will be explained with focus on the points of difference from the fourth embodiment. As shown FIG. 25, the outboard motor 10 of the sixth embodiment is provided with a fourth operator switch 190 and a fifth operator switch 192. The fourth operator switch 190 and fifth operator switch 192 are both located to be operable by the operator. When operated, the fourth operator switch 190 produces an output (ON signal) indicating that leftward steering of the outboard motor 10 has been mechanically stopped by the left steer stop 180. When operated, the fifth operator switch 192 produces an output (ON signal) indicating that rightward steering of the outboard motor 10 has been mechanically stopped by the right steer stop 182. The output of the fourth operator switch 190 and the output of the fifth operator switch 192 are sent to the ECU 26.

Figure 26:
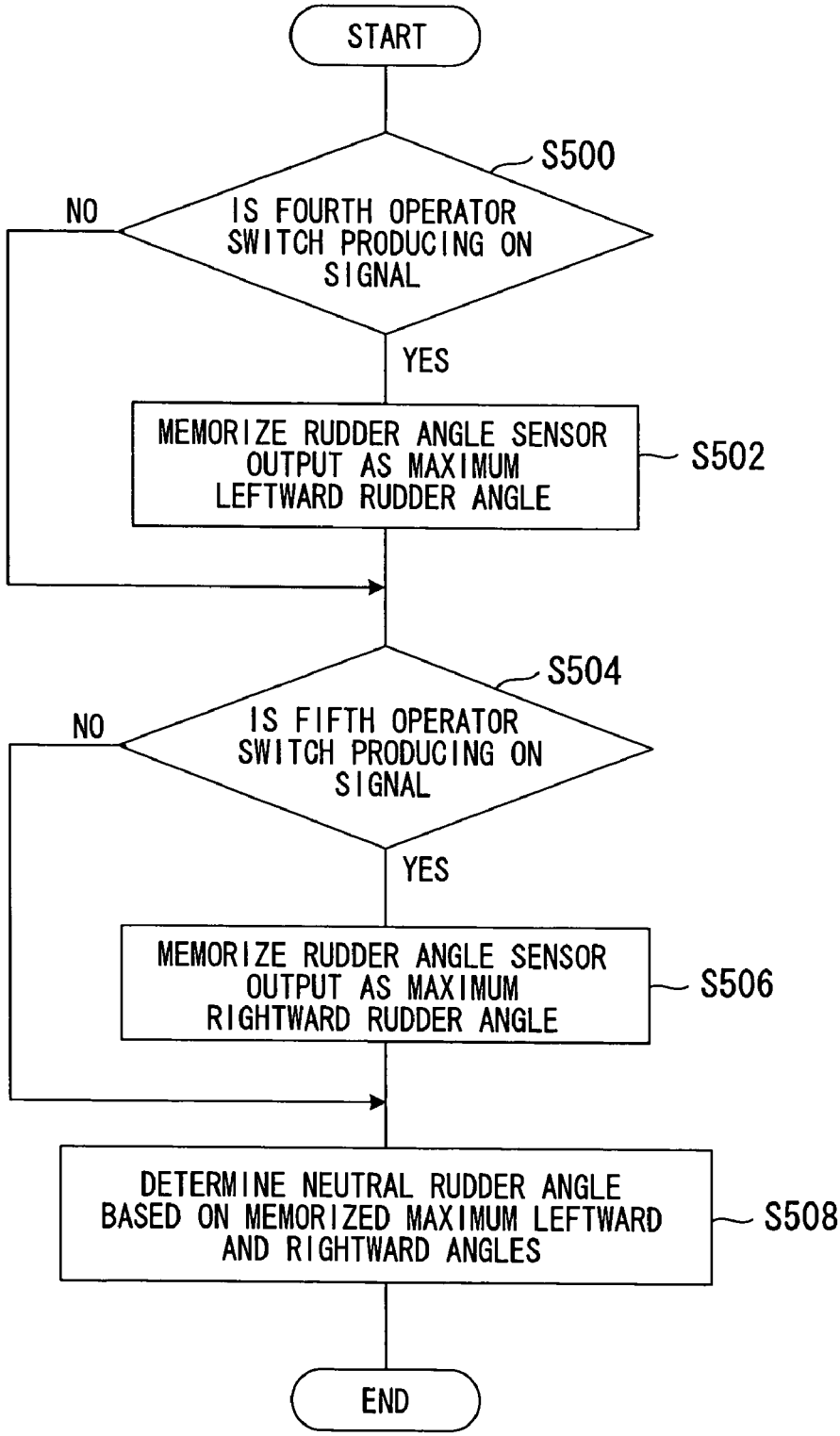
FIG. 26 is a flowchart showing the sequence of the processing operations of the control system shown in FIG. 25.

FIG. 26 is a flowchart showing the sequence of the processing operations executed by the outboard motor control system according to the sixth embodiment for determining a desired value (desired value for control purposes when steering the outboard motor 10 to a maximum rudder angle or the neutral rudder angle). The illustrated routine is executed by the ECU 26 at predetermined intervals (e.g., every 10 milliseconds).

In S500 of the flowchart of FIG. 26, it is determined whether the fourth operator switch 190 is producing an ON signal. When the result in S500 is YES, the program goes to S502, in which the output of the rudder angle sensor 40 at that time is memorized (stored) in the RAM of the ECU 26 as indicating the maximum leftward rudder angle.

Next, in S504, it is determined whether the fifth operator switch 192 is producing an ON signal. When the result in S504 is YES, the program goes to S506, in which the output of the rudder angle sensor 40 at that time is memorized (stored) in the RAM of the ECU 26 as indicating the maximum rightward rudder angle.

The operator can therefore store desired values that take the unit-specific properties of the outboard motor 10 into account in the ECU 26 by opening the manual valve 170, manually steering the outboard motor 10 leftward, operating the fourth operator switch 190 when leftward steering of the outboard motor 10 is mechanically stopped by the left steer stop 180, manually steering the outboard motor 10 rightward, and operating the fifth operator switch 192 when rightward steering of the outboard motor 10 is mechanically stopped by the right steer stop 182.

Next, S508, the neutral rudder angle is determined or defined based on the maximum leftward rudder angle and maximum rightward rudder angle memorized (stored in memory). This is done by the same processing as in S312 of the flowchart of FIG. 22 and will not be explained again here. When the result in S500 is NO, S502 is skipped. When the result in S504 is NO, S506 is skipped.

As explained in the foregoing, the sixth embodiment of this invention provides an outboard motor control system that steers the outboard motor 10 leftward and rightward using the hydraulic cylinder (actuator) 35, which outboard motor control system comprises: the left steer stop 180 for mechanically stopping leftward steering of the outboard motor 10; the right steer stop 182 for mechanically stopping rightward steering of the outboard motor 10; the rudder angle sensor 40 for producing an output indicating the rudder angle of the outboard motor 10; the manual steering mechanism (manual valve 170) operable by the operator for enabling manual steering of the outboard motor 10; the fourth operator switch 190 located to be operable by the operator that when operated produces an output indicating that leftward steering of the outboard motor 10 has been stopped by the left steer stop 180; the fifth operator switch 192 located to be operable by the operator that when operated produces an output indicating that rightward steering of the outboard motor 10 has been stopped by the right steer stop 182; and maximum rudder angle memorizer (the ECU 26, S502, S506) for memorizing (storing) the output of the rudder angle sensor 40 as the maximum leftward rudder angle of the outboard motor 10 when the fourth operator switch 190 produces the aforesaid output and memorizing (storing) the output of the rudder angle sensor 40 as the maximum rightward rudder angle of the outboard motor 10 when the fifth operator switch 192 produces the aforesaid output.

Owing to this configuration, the desired values for control purposes when steering the outboard motor 10 to the maximum rudder angles can be determined or defined as values that take the unit-specific properties of the outboard motor 10 into account. As a result, the rudder angle of the outboard motor 10 can be regulated to the maximum rudder angles with good accuracy, thereby preventing degradation of turning performance owing to insufficient rudder angle and interference between constituent members owing to excessive rudder angle.

Moreover, the outboard motor control system according to the sixth embodiment is configured to further comprise neutral rudder angle determiner (the ECU 26, S508) for determining or defining the average value of the maximum leftward rudder angle and maximum rightward rudder angle stored in memory as the neutral rudder angle. Therefore, as in the fourth embodiment, the desired value for control purposes when steering the outboard motor 10 to the neutral rudder angle can be determined as a value that takes the unit-specific properties of the outboard motor 10 into account. As a result, the rudder angle of the outboard motor 10 can be regulated to the neutral rudder angle with good accuracy.

Although the actuator for steering the outboard motor 10 is exemplified as the hydraulic cylinder 35 in the foregoing description, it can instead be an electric motor or any of various other kinds of actuator.

In the sixth embodiment, it is possible to provide a switch for disabling the operation of the fourth operator switch 190 and fifth operator switch 192 so as to prevent unintended storage in memory of the maximum rudder angles.

Thus, the first to second embodiments are configured to have a system for controlling shift change of an outboard motor (10) mounted on a stern of a boat (12) and having an internal combustion engine (28) to power a propeller (32), comprising: a clutch (102) being engageable with a forward gear (98) to make the boat to propel in a forward direction or a reverse gear (100) to make the boat to propel in a reverse direction; an actuator (shift motor 38) moving the clutch to one from among a first position to engage with the forward gear to establish a forward position, a second position to engage with the reverse gear to establish a reverse position, and a third position to engage neither with the forward gear nor with the reverse gear to establish a neutral position; a switch (neutral switch 48, operator switch 134) producing an output when the clutch is moved to the third position; a clutch position memorizer (ECU 26, S14, S102) memorizing a position of the clutch as the neutral position when the switch produces the output; and a clutch position determiner (ECU 26, S16, S104) determining a position of the clutch corresponding to the first position or the second position based on the memorized position of the clutch.

In the system, the switch comprises a neutral switch (48) that is connected to the clutch and produces the output when the clutch is moved to the third position.

In the system, the clutch position determiner determines the position of the clutch corresponding to the first position or the second position at a position moved from the neutral position by a predetermined amount (+/−36° in terms of the rotation angle of the rotary shaft 110*m*).

In the system, the switch comprises an operator switch (134) located to be operable by an operator.

The system further includes: a manual shift mechanism (manual lever 132) located to be operable by the operator and to make the clutch move manually when operated by the operator; and the operator switch is located to be operable by the operator when the operator moves the clutch to the third position through the manual shift mechanism.

The third embodiment is configured to have a system for controlling shift change of an outboard motor (10) mounted on a stern of a boat (12) and having an internal combustion engine (28) to power a propeller 32), comprising: a clutch (102) being engageable with a forward gear to make the boat to propel in a forward direction or a reverse gear to make the boat to propel in a reverse direction; an actuator (shift motor 38) moving the clutch to one from among a first position to engage with the forward gear to establish a forward position, a second position to engage with the reverse gear to establish a reverse position, and a third position to engage neither with the forward gear nor with the reverse gear to establish a neutral position; a first operator switch (134) located to be operable by an operator and producing an output when the clutch is moved to the third position; a first clutch position memorizer (ECU 26, S202) memorizing a position of the clutch as the neutral position when the first operator switch produces the output; a second operator switch (136) located to be operable by the operator and producing an output when the clutch is moved to the first position; a second clutch position memorizer (ECU 26, S206) memorizing a position of the clutch as the first position when the second operator switch produces the output; a third operator switch (138) located to be operable by the operator and producing an output when the clutch is moved to the second position; and a third clutch position memorizer (ECU 26, S210) memorizing a position of the clutch as the second position when the third operator switch produces the output.

The system further includes: a manual shift mechanism (manual lever 132) located to be operable by the operator and to make the clutch move manually when operated by the operator; and the first to third operator switches are located to be operable by the operator when the operator moves the clutch to the positions through the manual shift mechanism.

The fourth to fifth embodiments are configured to have a system for controlling steering of an outboard motor (10) mounted on a stern of a boat (12) and having an internal combustion engine (28) to power a propeller (32), comprising: an actuator (hydraulic cylinder 35) steering the outboard motor relative to the boat; a left steer stop (180) mechanically stopping leftward steering of the outboard motor; a right steer stop (182) mechanically stopping rightward steering of the outboard motor: a rudder angle sensor (40) producing an output indicating a rudder angle of the outboard motor; and a maximum rudder angle memorizer (ECU 26, S304, S310) memorizing the output of the rudder angle sensor as a maximum leftward rudder angle of the outboard motor when the outboard motor is mechanically stopped by the left steer stop, while memorizing the output of the rudder angle sensor as a maximum rightward rudder angle of the outboard motor when the outboard motor is mechanically stopped by the right steer stop.

The system further includes: a neutral rudder angle determiner (ECU 26, S312) determining an average value of the memorized maximum leftward rudder angle and maximum rightward rudder angle as a neutral rudder angle.

The system further includes: a desired-value-set switch (188) located to be operable by an operator; and a desired value determiner (ECU 26, S400, S402) determining a desired value when steering the outboard motor to the maximum rudder angle or a neutral rudder angle when the desired-value-set switch produces an output.

The sixth embodiment is thus configured to have a system for controlling steering of an outboard motor (10) mounted on a stern of a boat (12) and having an internal combustion engine (28) to power a propeller (32), comprising: an actuator (hydraulic cylinder 35) steering the outboard motor relative to the boat; a left steer stop (180) mechanically stopping leftward steering of the outboard motor; a right steer stop (182) mechanically stopping rightward steering of the outboard motor: a rudder angle sensor (40) producing an output indicating a rudder angle of the outboard motor; a first operator switch (fourth operator switch 190) located to be operable by the operator and when operated, producing an output indicating that leftward steering of the outboard motor is stopped by the left steer stop; a second operator switch (fifth operator switch 192) located to be operable by the operator and when operated, producing an output indicating that rightward steering of the outboard motor is stopped by the right steer stop; and a maximum rudder angle memorizer (ECU 26, S502, S506) memorizing the output of the rudder angle sensor as the maximum leftward rudder angle of the outboard motor when the first operator switch produces the output, while memorizing the output of the rudder angle sensor as the maximum rightward rudder angle of the outboard motor when the second operator switch produces the output.

The system further includes: a neutral rudder angle determiner (ECU 26, S508) determining an average value of the memorized maximum leftward rudder angle and maximum rightward rudder angle as a neutral rudder angle.

The system further includes: a manual steering mechanism (manual valve 170) operable by an operator for enabling manual steering of the outboard motor.

It should be noted that one of the first to third embodiments can be combined together with one of the fourth to sixth embodiment. For example, the first embodiment can be combined into the fourth embodiment.

Japanese Patent Application Nos. 2005-143647 filed on May 17, 2005 and 2005-148016 filed on May 20, 2005 are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling shift change of an outboard motor mounted on a stem of a boat and having an internal combustion engine to power a propeller, said system comprising:

a clutch being engageable with a forward gear to make the boat propel in a forward direction or a reverse gear to make the boat propel in a reverse direction;

an actuator for moving the clutch to one position selected from among a first position to engage with the forward gear to establish a forward position, a second position to engage with the reverse gear to establish a reverse position, and a third position to engage neither with the forward gear nor with the reverse gear to establish a neutral position;

a switch for producing an output signal when the clutch is moved to the third position; and a controller which controls operations of said actuator, said controller including:

a clutch position memorizer for memorizing a position of the clutch as the neutral position when the switch produces the output; and a clutch position determiner for determining a position of the clutch corresponding to the first position or the second position based on the memorized position of the clutch.

2. The system according to claim 1, wherein the switch comprises a neutral switch that is connected to the clutch and produces the output when the clutch is moved to the third position.

3. The system according to claim 2, wherein the clutch position determiner determines the position of the clutch corresponding to the first position or the second position at a position moved from the neutral position by a predetermined amount.

4. The system according to claim 1, wherein the switch comprises an operator switch located to be operable by an operator, and the system further comprises:

manual shift mechanism located to be operable by the operator and to make the clutch move manually when operated by the operator;

and the operator switch is located to be operable by the operator when the operator moves the clutch to the third position through the manual shift mechanism.

5. The system according to claim 4, wherein the clutch position determiner determines the position of the clutch corresponding to the first position or the second position at a position moved from the neutral position by a predetermined amount.

6. The system according to claim 1, further including:

an actuator steering the outboard motor relative to the boat;

a left steer stop mechanically stopping leftward steering of the outboard motor;

a right steer stop mechanically stopping rightward steering of the outboard motor; and a rudder angle sensor producing an output indicating a rudder angle of the outboard motor;

wherein the controller further includes a maximum rudder angle memorizer memorizing the output of the rudder angle sensor as a maximum leftward rudder angle of the outboard motor when the outboard motor is mechanically stopped by the left steer stop, while memorizing the output of the rudder angle sensor as a maximum rightward rudder angle of the outboard motor when the outboard motor is mechanically stopped by the right steer stop.

7. The system according to claim 6, the controller further including:

a neutral rudder angle determiner determining an average value of the memorized maximum leftward rudder angle and maximum rightward rudder angle as a neutral rudder angle.

8. The system according to claim 6, further including:

a desired-value-set switch located to be operable by an operator and when operated, producing an output; and a desired value determiner determining a desired value when steering the outboard motor to the maximum leftward rudder angle or the maximum rightward rudder angle.

9. The system according to claim 1, further including:

an actuator steering the outboard motor relative to the boat;

a left steer stop mechanically stopping leftward steering of the outboard motor;

a right steer stop mechanically stopping rightward steering of the outboard motor;

a rudder angle sensor producing an output indicating a rudder angle of the outboard motor;

a first operator switch located to be operable by the operator and when operated, producing an output indicating that leftward steering of the outboard motor is stopped by the left steer stop; and a second operator switch located to be operable by the operator and when operated, producing an output indicating that rightward steering of the outboard motor is stopped by the right steer stop;

wherein the controller further includes a maximum rudder angle memorizer memorizing the output of the rudder angle sensor as the maximum leftward rudder angle of the outboard motor when the first operator switch produces the output, while memorizing the output of the rudder angle sensor as the maximum rightward rudder angle of the outboard motor when the second operator switch produces the output.

10. The system according to claim 9, the controller further including:

a neutral rudder angle determiner determining an average value of the memorized maximum leftward rudder angle and maximum rightward rudder angle as a neutral rudder angle.

11. The system according to claim 9, further including:

a manual steering mechanism operable by the operator for enabling manual steering of the outboard motor.

* * * * *